US007963475B2

(12) United States Patent
Rodrian

(10) Patent No.: US 7,963,475 B2
(45) **Date of Patent: *Jun. 21, 2011**

(54) METHOD AND APPARATUS FOR CONTROLLING A DISPENSER AND DETECTING A USER

(75) Inventor: James A. Rodrian, Grafton, WI (US)

(73) Assignee: Alwin Manufacturing Co., Inc., Green Bay, WI (US)

( * ) Notice: Subject to any disclaimer, the term of this patent is extended or adjusted under 35 U.S.C. 154(b) by 1129 days.

This patent is subject to a terminal disclaimer.

(21) Appl. No.: 11/566,465

(22) Filed: Dec. 4, 2006

(65) Prior Publication Data

US 2007/0158359 A1 Jul. 12, 2007

Related U.S. Application Data

(60) Provisional application No. 60/749,139, filed on Dec. 8, 2005.

(51) Int. Cl.
*B65H 63/08* (2006.01)

(52) U.S. Cl. ..... 242/563.2; 242/564.1; 242/565; 222/63; 340/562; 340/686.1

(58) Field of Classification Search ..... 242/564, 242/564.1, 565, 563, 579, 912, 390, 390.2, 242/563.2; 33/733, 750; 222/52, 61, 63, 222/192; 340/686.6, 562, 565, 593, 648, 340/686.1; 221/9, 13

See application file for complete search history.

(56) References Cited

U.S. PATENT DOCUMENTS

| | | | | |
|---|---|---|---|---|
| 3,067,364 | A | 12/1962 | Rosso | |
| 3,317,150 | A | 5/1967 | Summersby | |
| 3,450,363 | A | 6/1969 | Williams | |
| 3,505,692 | A | 4/1970 | Forbes | |
| 3,555,534 | A * | 1/1971 | Akers et al | 340/562 |
| 3,669,312 | A | 6/1972 | Kuckens et al. | |
| 3,675,051 | A | 7/1972 | Mioduski | |
| 3,730,409 | A | 5/1973 | Ratti | |
| 3,892,368 | A | 7/1975 | Ricards | |
| 3,971,607 | A | 7/1976 | Schnyder | |
| 4,119,255 | A | 10/1978 | D'Angelo | |
| 4,270,818 | A | 6/1981 | McCabe | |
| 4,398,310 | A | 8/1983 | Lienhard | |
| 4,449,122 | A | 5/1984 | Whitmer | |
| 4,450,398 | A | 5/1984 | Bose | |
| 4,463,426 | A | 7/1984 | Caddick et al. | |
| 4,666,099 | A | 5/1987 | Hoffman et al. | |
| 4,722,372 | A | 2/1988 | Hoffman et al. | |

(Continued)

FOREIGN PATENT DOCUMENTS

CA 2294820 5/1999

(Continued)

OTHER PUBLICATIONS

U.S. Appl. No. 60/130,137, filed Apr. 20, 1999 (Omdoll et al.).

(Continued)

*Primary Examiner* — William A Rivera
(74) *Attorney, Agent, or Firm* — Jansson Shupe & Munger Ltd.

(57) ABSTRACT

Automatic dispensers, proximity detectors and user-detection methods. A proximity detector can be used to trigger operation of the dispenser to dispense products such as towel, tissue, wipes, sheet-form materials, soap, shaving cream, fragrances and personal care products.

30 Claims, 20 Drawing Sheets

U.S. PATENT DOCUMENTS 4,738,176 A 4/1988 Cassia
4,765,555 A 8/1988 Gambino
4,786,005 A 11/1988 Hoffman et al.
4,796,825 A 1/1989 Hawkins
4,826,262 A 5/1989 Hartman et al.
4,879,461 A 11/1989 Philipp
4,910,464 A * 3/1990 Trett et al. ..... 340/552
4,921,131 A 5/1990 Binderbauer et al.
4,938,384 A 7/1990 Pilolla et al.
4,946,070 A 8/1990 Albert et al.
4,960,248 A 10/1990 Bauer et al.
4,967,935 A 11/1990 Celest
5,031,258 A 7/1991 Shaw
5,060,323 A 10/1991 Shaw
5,086,526 A 2/1992 Van Marcke
5,105,992 A 4/1992 Fender et al.
5,126,078 A 6/1992 Steiner et al.
5,199,118 A 4/1993 Cole et al.
5,217,035 A 6/1993 Van Marcke
5,255,822 A 10/1993 Mease et al.
5,291,534 A 3/1994 Sakurai et al.
5,316,124 A 5/1994 Barnes et al.
5,340,045 A 8/1994 Arabian et al.
5,365,221 A 11/1994 Fennell et al.
5,452,832 A 9/1995 Niada
5,490,722 A 2/1996 Sonnett et al.
5,492,247 A 2/1996 Shu et al.
5,497,326 A 3/1996 Berland et al.
5,514,977 A 5/1996 Agiman
5,573,318 A 11/1996 Arabian et al.
5,625,908 A 5/1997 Shaw
5,632,414 A 5/1997 Merriweather, Jr.
5,651,044 A 7/1997 Klotz, Jr. et al.
5,665,961 A 9/1997 Matzka
5,694,653 A 12/1997 Harald
5,695,091 A 12/1997 Winings et al.
5,730,165 A 3/1998 Philipp
5,772,291 A 6/1998 Byrd et al.
5,781,942 A 7/1998 Allen et al.
5,806,203 A 9/1998 Robinson
5,810,201 A 9/1998 Besse et al.
5,836,482 A 11/1998 Ophardt et al.
5,862,844 A 1/1999 Perrin
5,933,288 A 8/1999 Plesko
5,943,712 A 8/1999 Van Marcke
5,952,835 A 9/1999 Coveley
5,960,991 A 10/1999 Ophardt
5,961,066 A 10/1999 Hambleton
5,988,440 A 11/1999 Saunders et al.
5,992,430 A 11/1999 Chardack et al.
6,000,429 A 12/1999 Van Marcke
6,025,782 A 2/2000 Newham
6,069,354 A 5/2000 Alfano et al.
6,082,419 A 7/2000 Skell et al.
6,098,917 A 8/2000 Cruz
6,105,898 A 8/2000 Byrd et al.
6,119,285 A 9/2000 Kim
6,125,482 A 10/2000 Foster
6,128,826 A 10/2000 Robinson
6,131,587 A 10/2000 Chardack et al.
6,170,241 B1 1/2001 Shibilski et al.
6,178,572 B1 1/2001 Van Marcke
6,189,163 B1 2/2001 Van Marcke
6,195,588 B1 2/2001 Gauthier et al.
6,206,340 B1 3/2001 Paese et al.
6,209,751 B1 4/2001 Goodin et al.
6,209,752 B1 4/2001 Mitchell et al.
6,243,635 B1 6/2001 Swan et al.
6,250,530 B1 6/2001 LaCount et al.
6,262,546 B1 7/2001 Draves et al.
6,273,394 B1 8/2001 Vincent et al.
6,283,504 B1 9/2001 Stanley et al.
6,288,707 B1 9/2001 Philipp
6,293,486 B1 9/2001 Byrd et al.
6,297,738 B1 10/2001 Newham
6,384,724 B1 5/2002 Landais
6,412,655 B1 7/2002 Stuetzel et al.
6,412,679 B2 7/2002 Formon et al.
6,419,136 B2 7/2002 Formon et al.
6,446,901 B1 9/2002 Haen et al.
6,460,798 B1 10/2002 Haen et al.
6,546,344 B1 4/2003 Rodrian et al.
6,592,067 B2 7/2003 Denen et al.
6,695,246 B1 2/2004 Elliott et al.
6,710,606 B2 3/2004 Morris
6,742,689 B2 6/2004 Formon et al.
6,745,927 B2 6/2004 Formon et al.
6,766,977 B2 7/2004 Denen et al.
6,830,210 B2 12/2004 Formon et al.
6,838,887 B2 1/2005 Denen et al.
6,854,684 B2 2/2005 Byrd et al.
6,871,815 B2 3/2005 Moody et al.
6,903,654 B2 6/2005 Hansen et al.
6,977,588 B2 12/2005 Schotz et al.
6,988,689 B2 1/2006 Thomas et al.
7,084,592 B2 8/2006 Rodrian
7,114,677 B2 10/2006 Formon et al.
7,161,880 B2 1/2007 Okajima
7,231,317 B2 6/2007 Todd et al.
7,237,744 B2 7/2007 Morris et al.
7,296,765 B2 11/2007 Rodrian
7,325,767 B2 2/2008 Elliott et al.
7,325,768 B2 2/2008 Byrd et al.
7,341,170 B2 3/2008 Boone
7,354,015 B2 4/2008 Byrd et al.
7,398,944 B2 7/2008 Lewis et al.
7,624,664 B2 12/2009 Morris et al.
2002/0109035 A1* 8/2002 Denen et al. ..... 242/563
2002/0175814 A1* 11/2002 Wadlow et al. ..... 340/562
2003/0107341 A1 6/2003 Morris
2003/0222779 A1* 12/2003 Schotz et al. ..... 340/562
2004/0134924 A1* 7/2004 Hansen et al. ..... 221/9
2005/0072874 A1* 4/2005 Denen et al. ..... 242/563
2006/0175341 A1* 8/2006 Rodrian ..... 221/13
2007/0080255 A1 4/2007 Witt et al.

FOREIGN PATENT DOCUMENTS

CA 2342260 3/2001
DE 198 20 978 11/1999
EP 1 230 886 2/2002
EP 1 231 823 2/2002
EP 1 232 715 2/2002
GB 2 229 306 3/1989
WO WO 97/29671 8/1997
WO WO 99/58040 11/1999
WO WO 99/59457 11/1999
WO WO 00/63100 10/2000

OTHER PUBLICATIONS

U.S. Appl. No. 60/159,006, filed Oct. 11, 1999 (Hoyt).
Bay West Paper Corporation website excerpt (www.baywestpaper.com) and photograph of Bay West Wave 'n Dry dispenser (2 total pages), Date: 1997.
Ille Papier-Service GmbH product literature and excerpts from Ille website (www.ille.de). (7 pages), Undated.

* cited by examiner

METHOD AND APPARATUS FOR CONTROLLING A DISPENSER AND DETECTING A USER

RELATED APPLICATION

This application claims the benefit of U.S. Provisional Application Ser. No. 60/749,139, filed Dec. 8, 2005, the entire content of which is herein incorporated by reference.

FIELD

The field relates generally to the field of controls and, more particularly, to method and apparatus for controlling dispensers and for detecting users.

BACKGROUND

Automatic dispensers of various types are used to dispense a broad range of products, including, without limitation, towels, tissues, wipes, sheet-form materials, soap, shaving cream, fragrances and personal care products. Automatic dispensers include certain controls provided to make one or more aspects of dispenser operation automatic.

Many dispensers include a proximity detector used to detect a user proximate the dispenser and to trigger dispenser operation without direct contact between the user and the dispenser. These types of dispensers are frequently referred to as "touchless" or "hands free" dispensers. One advantage of a hands-free dispenser is that transfer of soil or germs from the dispenser to the user is limited. Limiting contact between the user and the dispenser may also contribute to a more attractive dispenser. Proximity detectors are useful in applications other than dispensers wherein it is desired to control a device.

The dispenser must operate reliably over many dispensing cycles. The proximity detector used to control dispenser operation must accurately detect a user and should discriminate against false detections. The dispenser and proximity detector should operate consistently under a variety of different conditions, for example conditions of fluctuating humidity. There is a need for improvement in these and other aspects of automatic dispenser and proximity detector design and operation.

DETAILED DESCRIPTION

Dispenser 10 embodiments will now be described with reference to the figures. Dispenser 10 shown in the figures is of a type useful in dispensing sheet material in the form of a web of paper towel. Embodiments include dispensers suitable for dispensing dispensable products other than sheet material in the form of paper towel. Proximity detectors are described in the context of automatic dispenser operation but may find use in controlling devices other than automatic dispensers.

Figure 1:
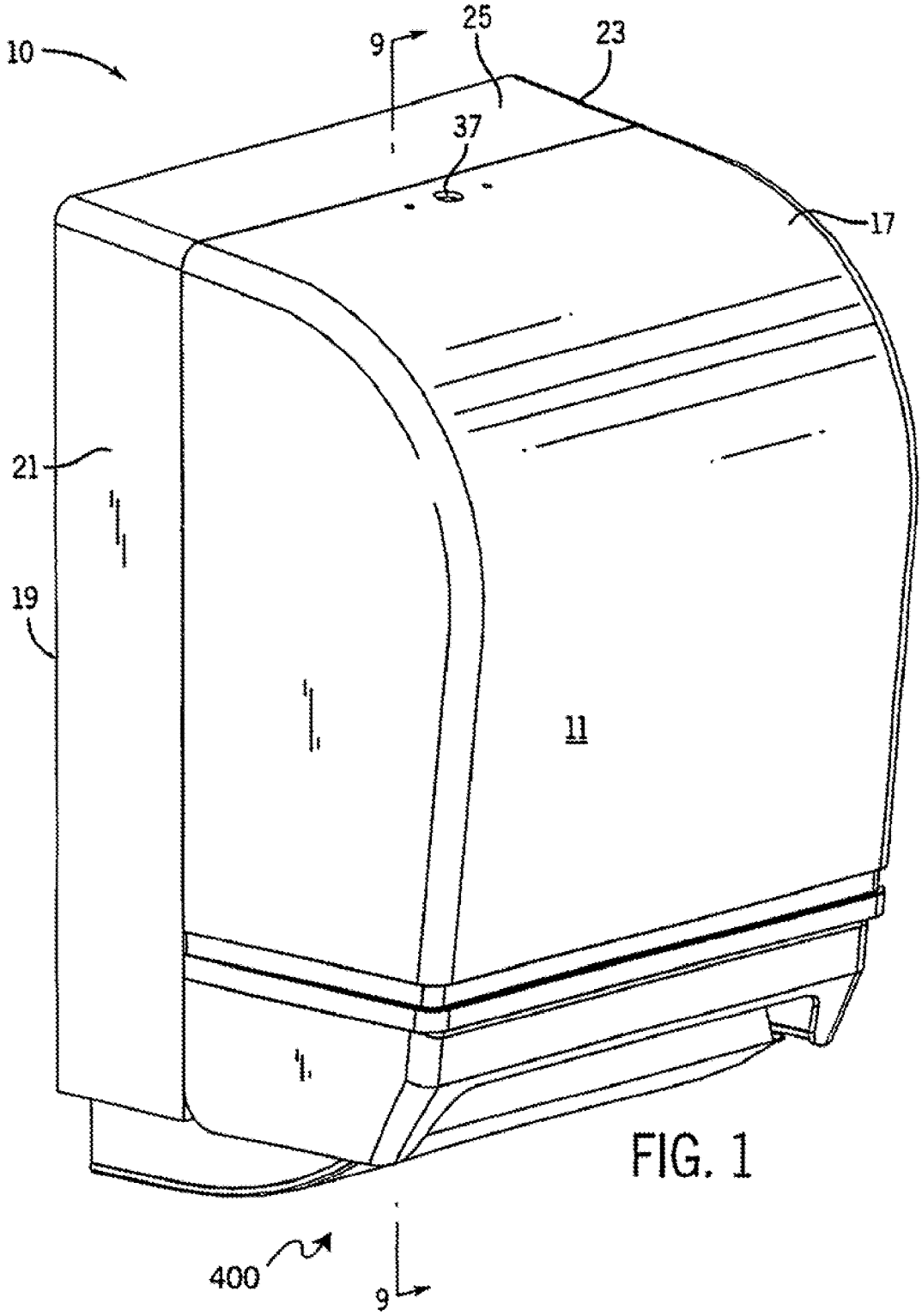
FIG. 1 is a perspective view of an automatic dispenser embodiment.
Figure 2:
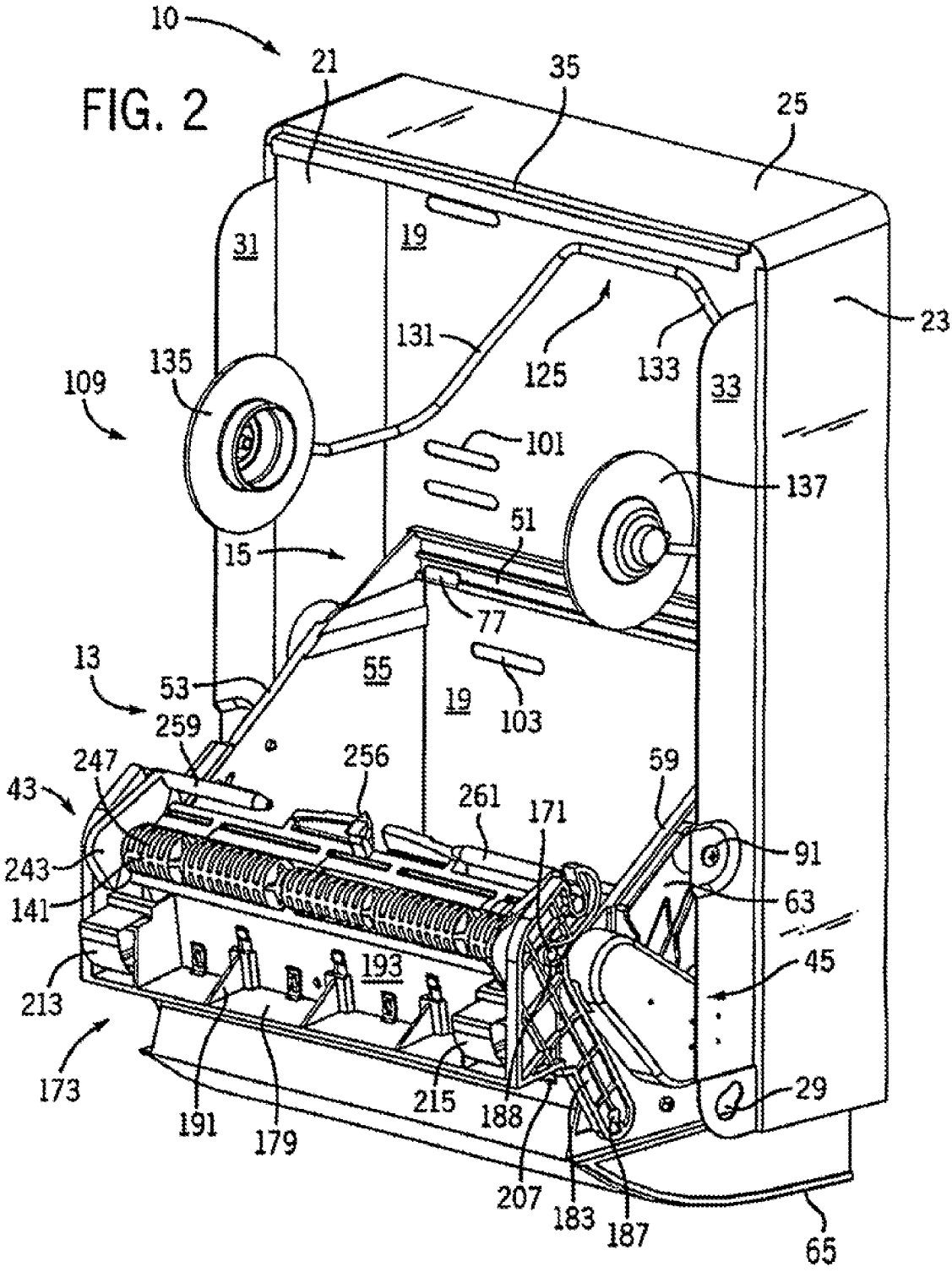
FIG. 2 is a perspective view of the dispenser of FIG. 1 with the housing cover removed.
Figure 3:
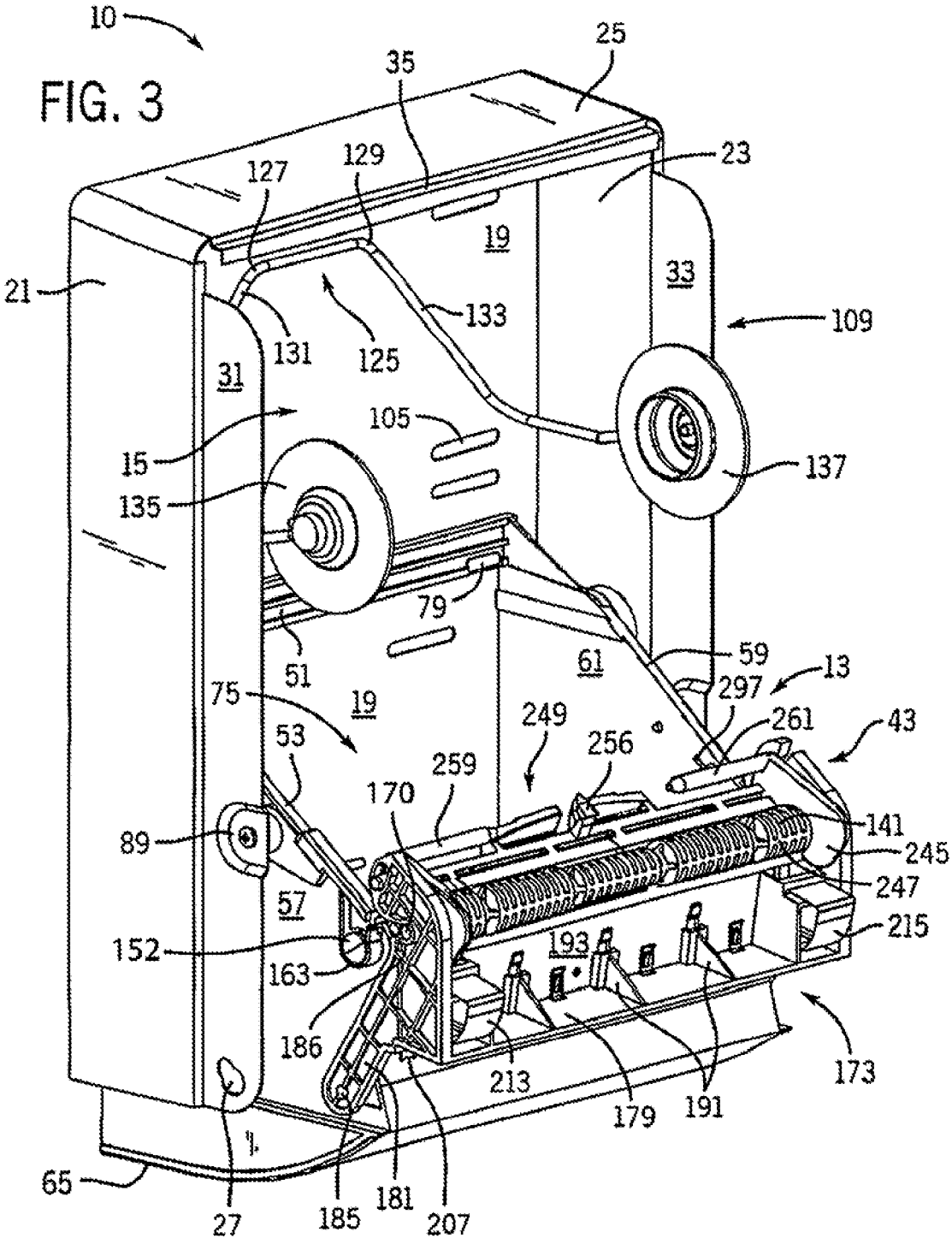
FIG. 3 is another perspective view of the dispenser of FIG. 1 also with the housing cover removed.
Figure 4:
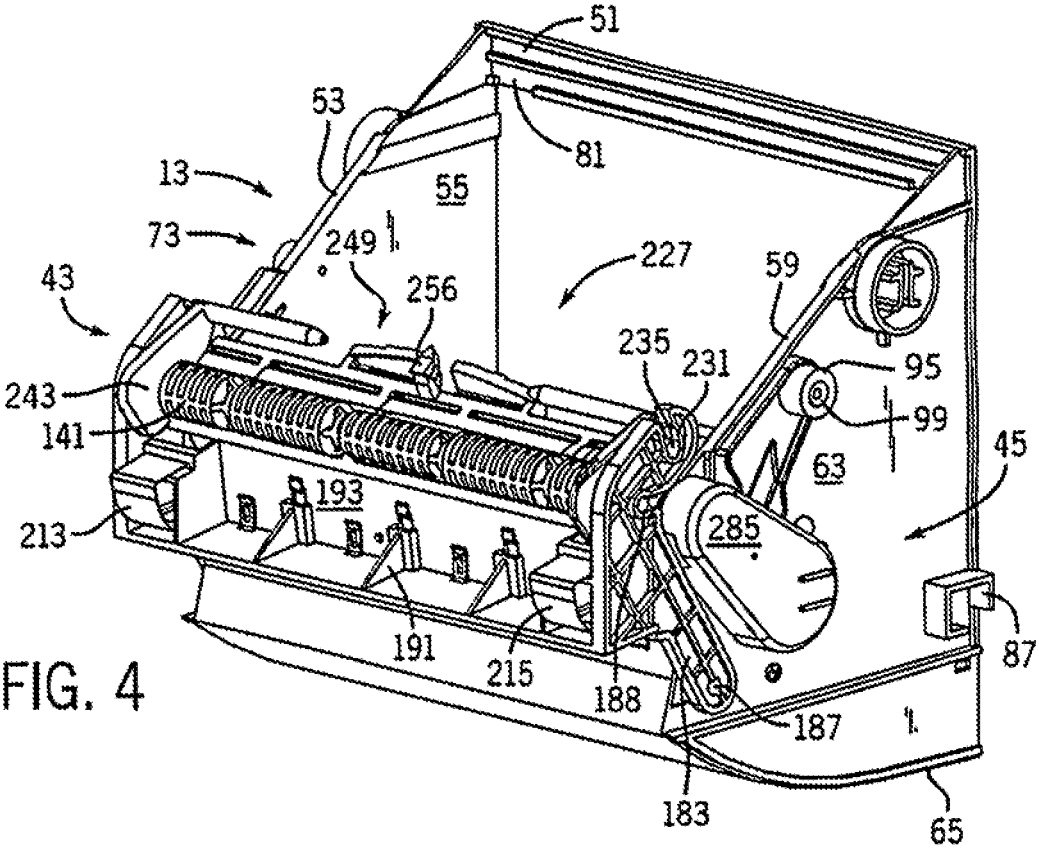
FIG. 4 is a perspective view of the front side of a dispenser frame embodiment.
Figure 5:
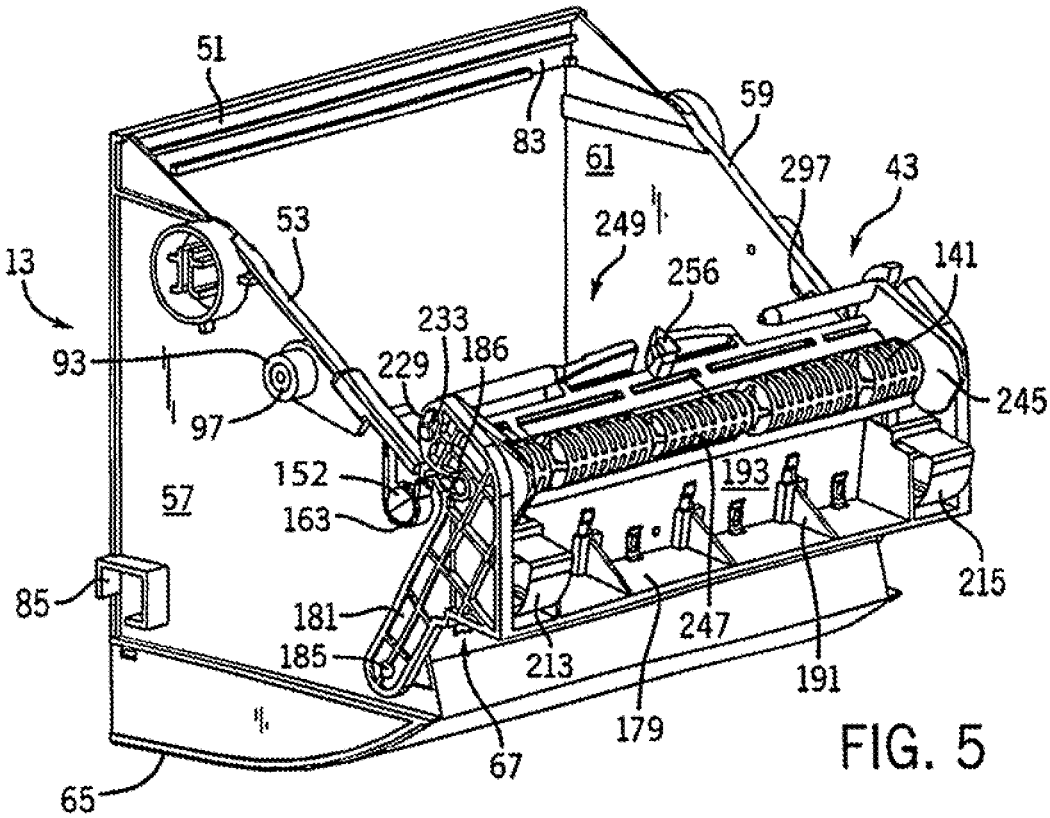
FIG. 5 is another perspective view of the dispenser frame of FIG. 4.
Figure 6:
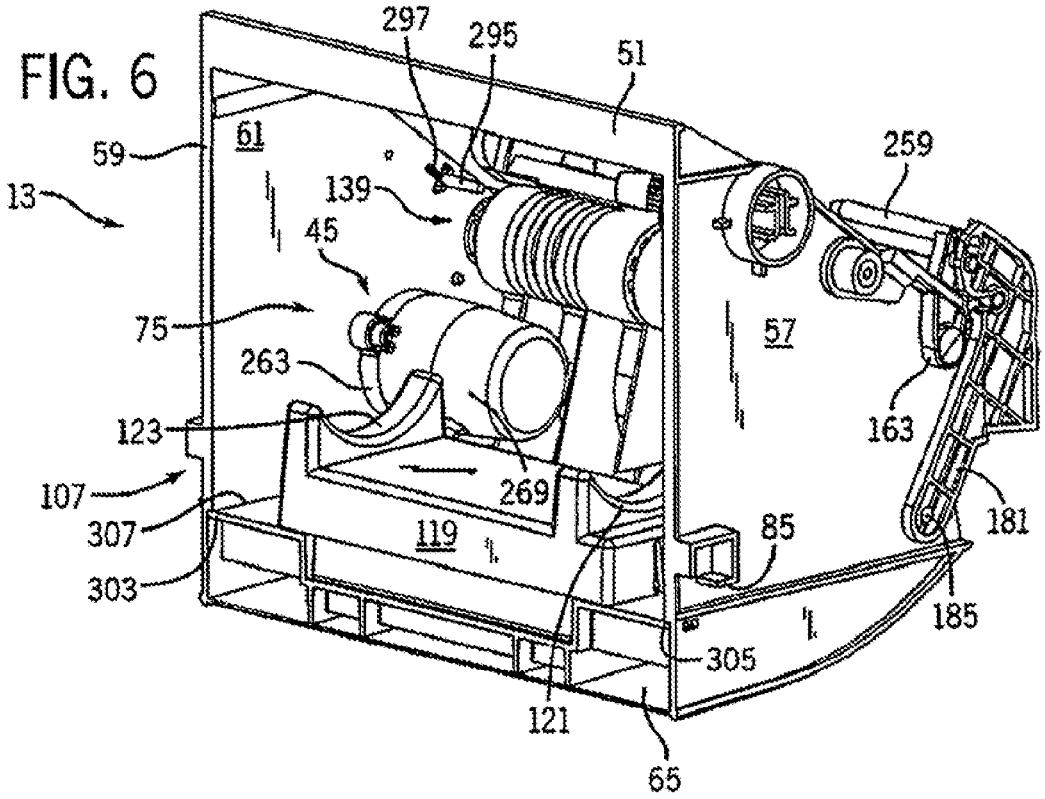
FIG. 6 is a perspective view of the rear side of the dispenser frame of FIG. 4.
Figure 7:
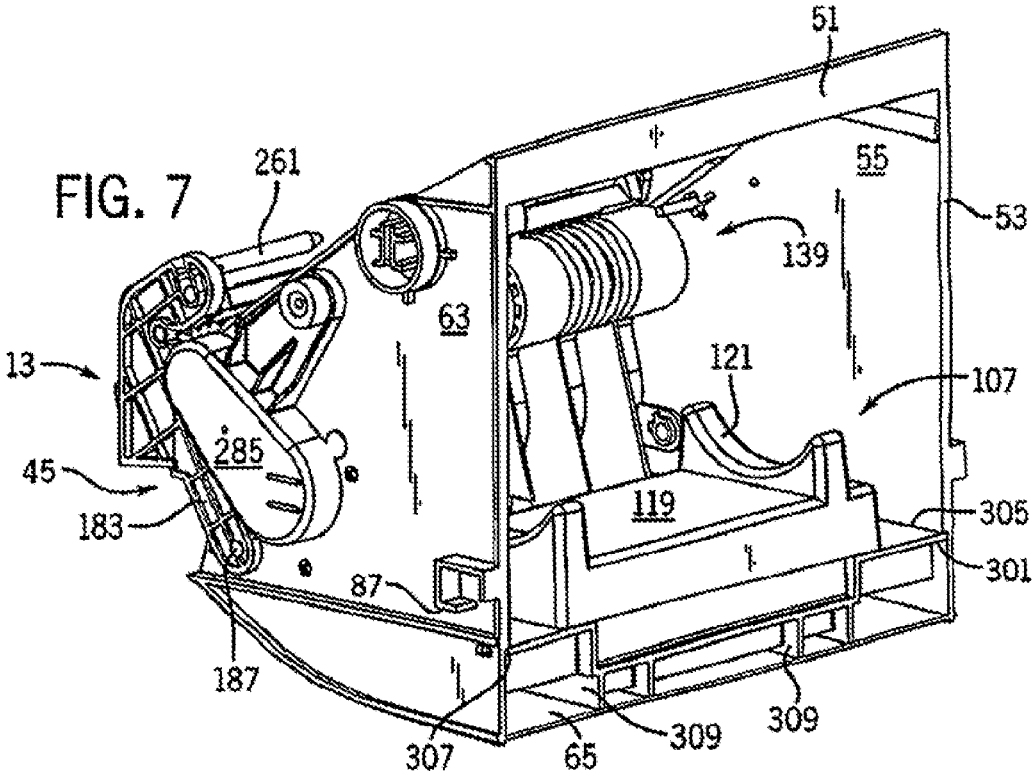
FIG. 7 is another perspective view of the rear side of the dispenser frame of FIG. 4.

Dispenser 10 preferably includes housing 11 and frame 13 mounted within an interior portion 15 of housing 11. Housing 111 may include a front cover 17, rear wall 19, sidewalls 21, 23 and top wall 25. Cover 17 may be connected to housing 11 in any suitable manner. As shown in FIGS. 1-3, cover 17 is attached for pivotal movement to housing 11 by means of axially-aligned pins (not shown) in cover 17 configured and arranged to mate with a respective axially aligned opening 27, 29 provided in housing sidewalls 21 and 23. Flanged wall surfaces 31, 33, 35 may be provided to extend into cover 17 when the cover 17 is in the closed position shown in FIG. 1 to ensure complete closure of the dispenser 10. A lock mechanism 37 may be provided in cover 17 to prevent unauthorized removal of cover 17. Cover 17 is opened, for example, to load rolls 39, 41 (FIGS. 9-10) of sheet material in the form of a web of paper towel into dispenser 10 or to service dispenser 10. Housing 11 and cover 17 may be made of any suitable material. Formed sheet metal and molded plastic are particularly suitable materials for use in manufacturing housing 11 and cover 17 because of their durability and ease of manufacture.

Figure 13:
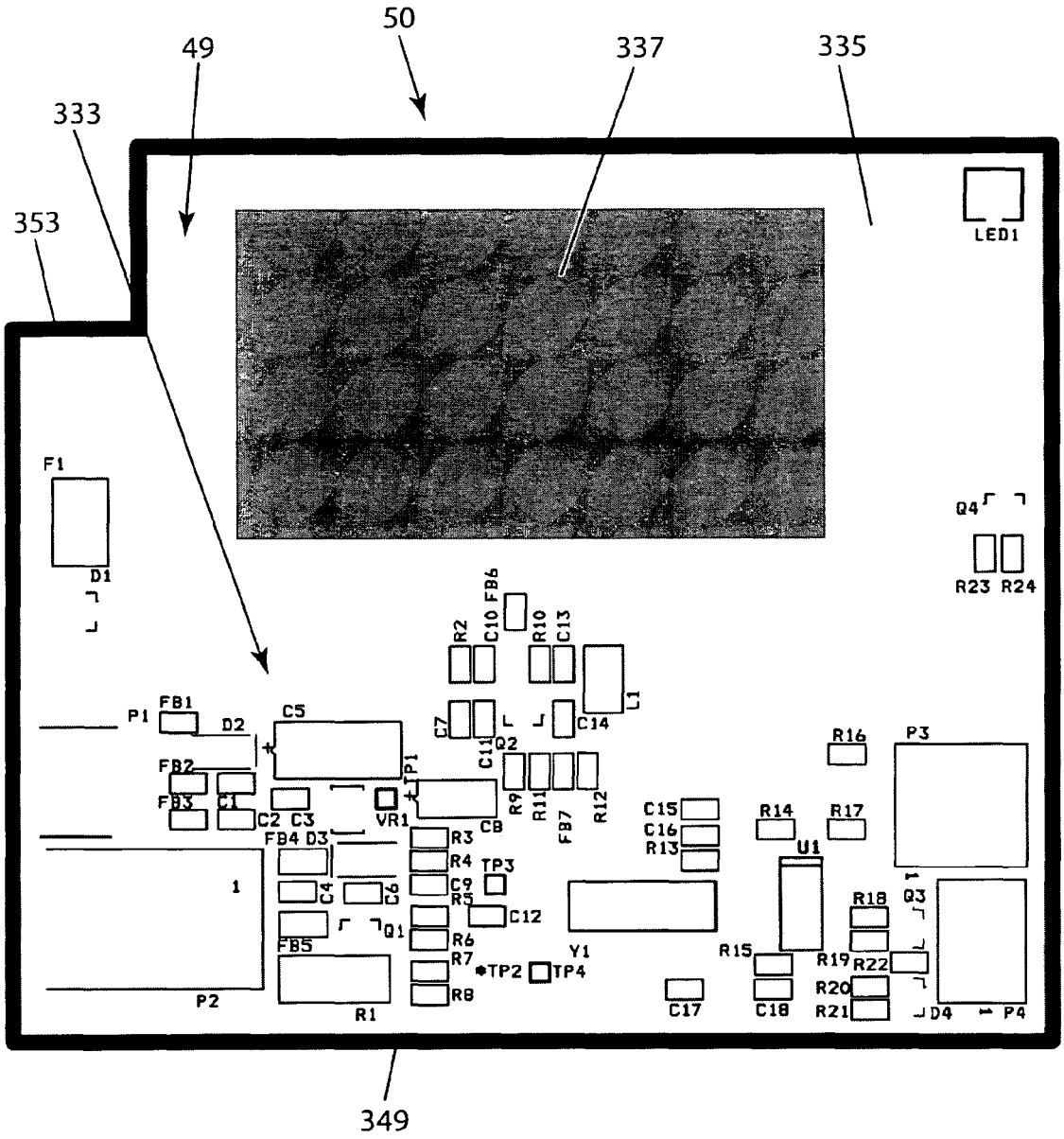
FIG. 13 is a schematic illustration of an exemplary circuit board and sensor.

Frame 13 and preferred components of exemplary dispenser 10 are shown in FIGS. 2 and 3 in which cover 17 is removed from dispenser 10 and in FIGS. 4-8 and 12 in which frame 13 is apart from housing 11. Frame 13 is preferably positioned within a portion of housing interior 15 as shown in FIGS. 2 and 3. Frame 13 is provided to support major mechanical and electrical components of dispenser 10 including dispensing mechanism 43, drive mechanism 45, power supply apparatus 47, proximity detector apparatus 49 and control apparatus 50 (shown in FIGS. 13, 14C and 18). Frame 13 is made of a material sufficiently sturdy to resist the forces applied by moving parts mounted thereon. Molded plastic is a highly preferred material for use in manufacture of frame 13.

Frame 13 shown in the figures includes a rear support member 51 (preferred frame 13 does not include a full rear wall), a first sidewall 53 having sidewall inner 55 and outer 57 surfaces, a second sidewall 59 having sidewall inner 61 and outer 63 surfaces and bottom wall 65. Discharge opening 67 is provided between web-guide surface 69 and tear bar 71. Sidewalls 53 and 59 define frame front opening 73. Housing rear wall 19, frame walls 53, 59, 65 and guide surface 69 define a space 75 in which a stub roll of sheet material 39 can be positioned for dispensing or storage.

Frame 13 is preferably secured along housing rear wall 19 in any suitable manner such as with brackets 77, 79 provided in housing rear wall 19. Brackets 77, 79 mate with corresponding slots 81 and 83 provided in frame rear support member 51. Frame 13 may also be secured in housing 11 by mounting brackets 85, 87 provided along frame sidewall outer surfaces 57, 63 for mating with corresponding brackets (not shown) provided in housing 11. Frame 13 may further be secured to housing 11 by means of fasteners 89, 91 positioned through housing sidewalls 21, 23, bushings 93, 95 and posts 97, 99. Frame 13 need not be a separate component and could, for example, be provided as an integral part of housing 11.

The exemplary dispenser 10 may be mounted on a vertical wall surface (not shown) where dispenser 10 can be easily accessed by a user. As shown particularly in FIGS. 2 and 3, dispenser 10 could be secured to such vertical wall surface by suitable fasteners (not shown) inserted through slotted openings in rear wall 19 of which slots 101, 103, 105 are representative. Of course, dispenser 10 could be configured in manners other than those described herein depending on the intended use of dispenser 10.

Figure 9:
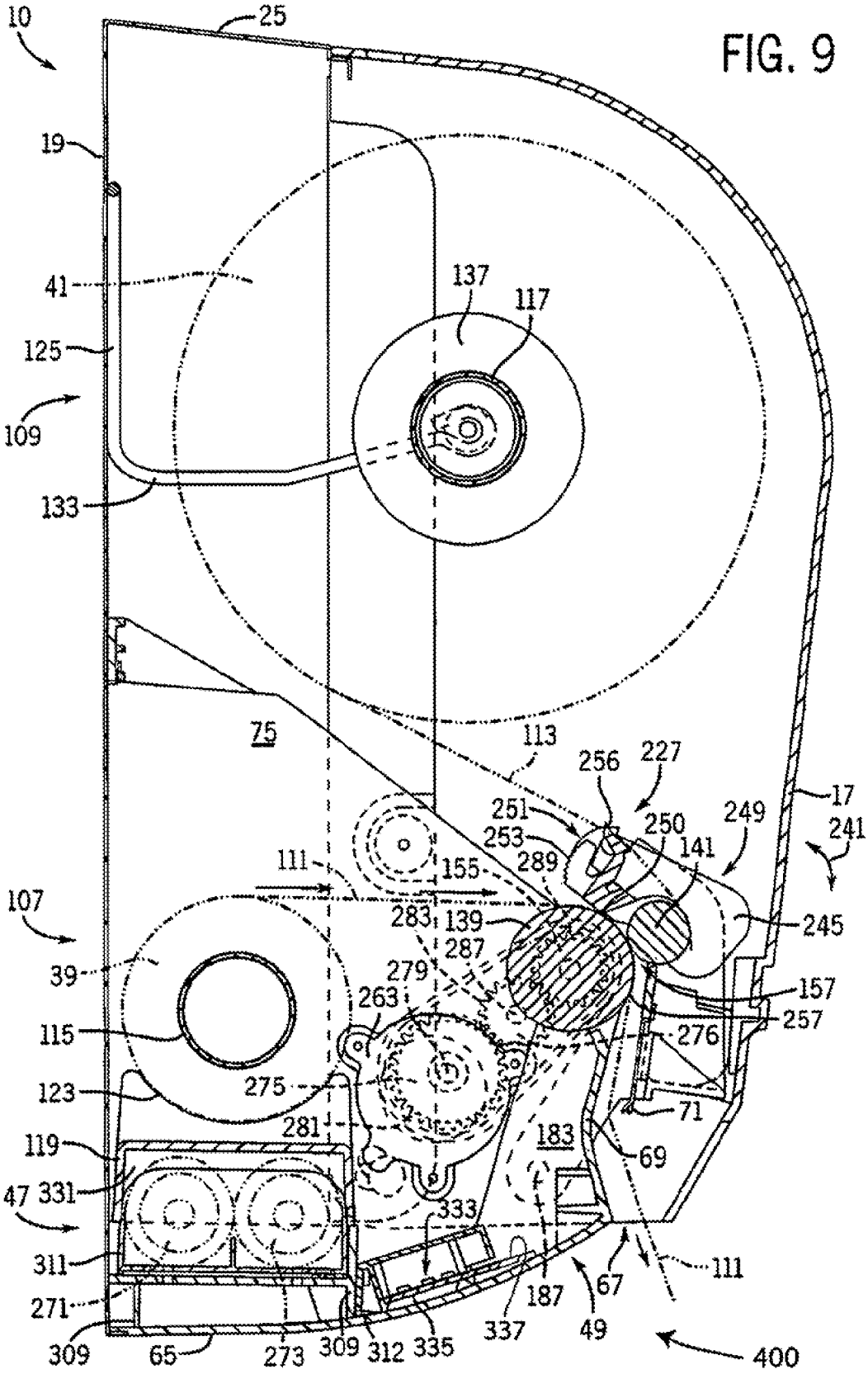
FIG. 9 is a sectional view of the exemplary dispenser taken along section 9-9 of FIG. 1. Sheet material is being dispensed from a stub roll. Certain hidden parts are shown in dashed lines.
Figure 10:
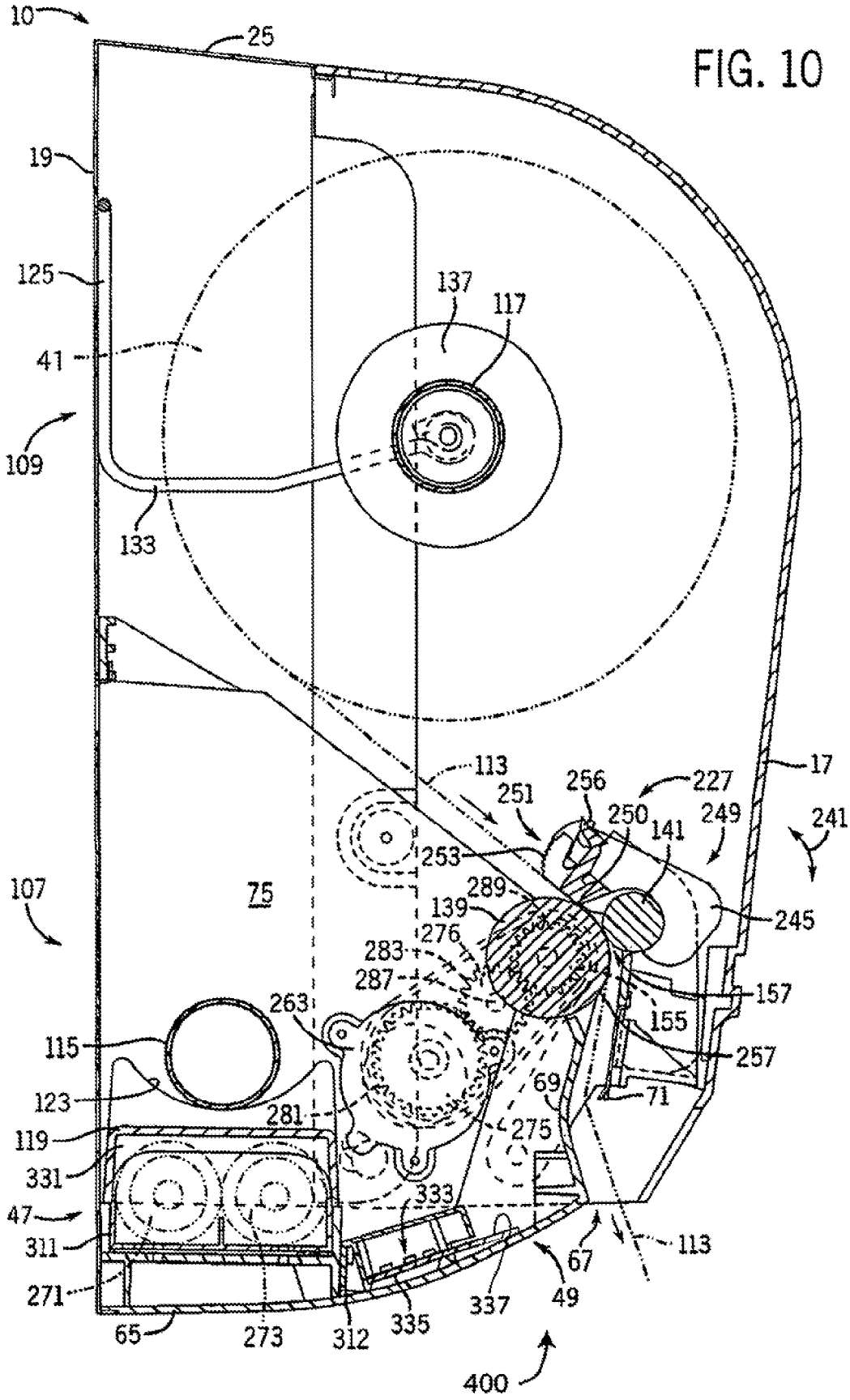
FIG. 10 is a further sectional view of the exemplary dispenser taken along section 9-9 of FIG. 1. Sheet material is being dispensed from a reserve roll. Certain hidden parts are shown in dashed lines.

The exemplary dispenser apparatus 10 includes apparatus 107, 109 for storing primary and secondary sources of sheet material. The sheet material in this example is in the form of primary and secondary rolls 39, 41. Primary roll 39 may be referred to herein as a "stub" roll while secondary roll 41 may be referred to as a reserve roll. A stub roll is a roll which is partially depleted of sheet material wound thereon. Rolls 39, 41 consist of primary and secondary sheet material 111, 113 wound onto a cylindrically-shaped hollow core 115, 117, said core 115, 117 having an axial length and opposed ends (not shown). Such cores 115, 117 are typically made of a cardboard-like material. As shown in FIG. 9, primary or stub roll 39 sheet material 111 is being dispensed while secondary or reserve roll 41 sheet material 113 is in a "ready" position prior to dispensing from that roll 41. FIG. 10 illustrates the dispenser 10 following a transfer event in which sheet material 113 from reserve roll 41 is transferred to the nip 157 for dispensing from the dispenser 10 following depletion of stub roll 39 sheet material 111.

It is very highly preferred that the rolls 39, 41 are stored in and dispensed from housing interior 15. However, there is no absolute requirement that such rolls be contained within housing interior 15 or space 75.

Turning now to the preferred apparatus 107 for storing primary or stub web roll 39, such storing apparatus 107 includes cradle 119 with arcuate support surfaces 121, 123 against which primary roll 39 rests. Surfaces 121, 123 are preferably made of a low-friction material permitting roll 39 to freely rotate as sheet material 111 is withdrawn from roll 39.

Referring further to FIGS. 2-3 and 9, there is shown a preferred apparatus 109 for storing secondary web roll 41. Storing apparatus 109 includes yoke 125 attached in a suitable manner to housing rear wall 19, such as by brackets 127, 129 formed around yoke 125. Yoke 125 comprises arms 131, 133 and web roll holders 135, 137 mounted on respective arms 131, 133. Arms 131 and 133 are preferably made of a resilient material so that they may be spread apart to receive respective ends of a hollow core roll on which the secondary sheet material web is wound.

Persons of skill in the art will appreciate that support structure, other than cradle 119 and yoke 125, could be used to support rolls 39, 41. By way of example only, a single removable rod (not shown) spanning between walls 53, 59 or 21, 23 could be used to support rolls 39, 41. As a further example, roll 39 could simply rest on frame bottom wall 65 without support at ends of the core 115. Dispenser 10 may be configured to dispense solely from a single source of sheet material.

A preferred dispensing mechanism 43 for feeding sheet material 111, 113 from respective rolls 39, 41 and out of dispenser 10 will next be described. Such dispensing mechanism 43 comprises drive roller 139, tension roller 141, drive motor 267 and the related components as hereinafter described and as shown particularly in FIGS. 2-10.

Drive roller 139 is rotatably mounted on frame 13. Drive roller may include a plurality of longitudinally spaced-apart drive roller segments 143, 145, 147 on a shaft 149. Drive roller 139 includes ends 151, 153 and drive gear 155 rigidly connected to end 153. Drive gear 155 is part of the dispensing mechanism 43 which rotates drive roller 139 as described in more detail below. Segments 143-147 rotate with shaft 149 and are preferably made of a tacky material such as rubber or other frictional materials such as sandpaper or the like provided for the purpose of engaging and feeding sheet material 111, 113 through a nip 157 between drive and tension rollers 139, 141 and out of the dispenser 10 through discharge opening 67.

Shaft end 153 is inserted in bearing 159 (for example, a nylon bearing) which is seated in opening 161 in frame sidewall 59. Stub shaft 152 at shaft end 151 is rotatably seated on bearing surface 163 in frame first sidewall 53 and is held in place by arm 167 mounted on post 97.

A plurality of teeth 169 may be provided to extend from guide surface 69 into corresponding annular grooves 172 around the circumference of drive roller outer surface 257. The action of teeth 169 in grooves 172 serves to separate any adhered sheet material 111, 113 from the drive roller 139 and to direct that material through the discharge opening 67.

Figure 8:
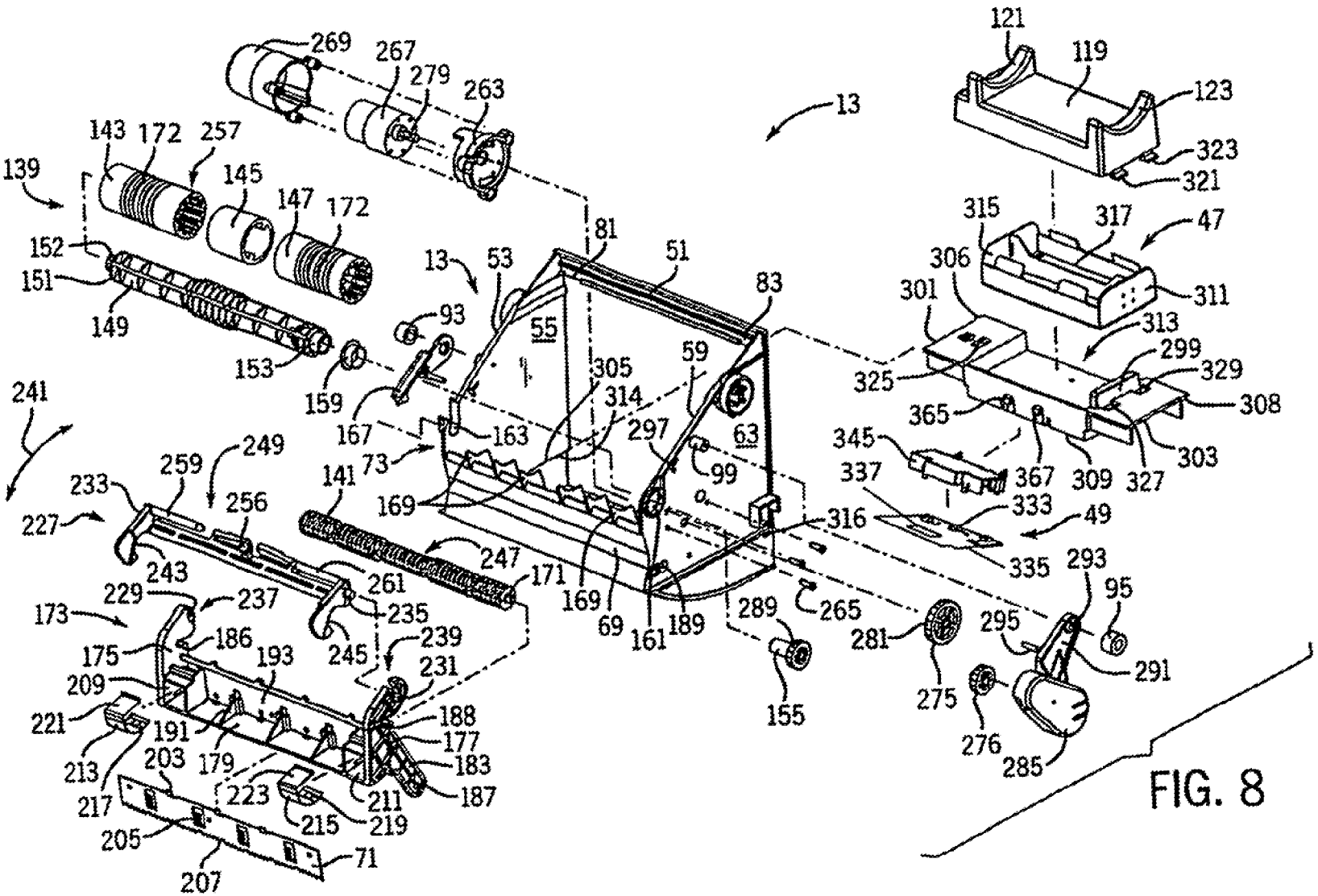
FIG. 8 is an exploded perspective view of a dispenser frame and certain preferred mechanical components.

The tension roller 141 is mounted for free rotation, preferably on a roller frame assembly 173. Tension roller 141 cooperates with drive roller 139 to form nip 157 and to maintain tension on sheet material 111, 113 enabling sheet material 111, 113 to be unwound from the respective roll 39, 41 during a dispense cycle. Roller frame assembly 173 may include spaced-apart sidewall members 175, 177 interconnected by a bottom plate 179. Roller frame assembly 173 may also be provided with arm extensions 181, 183 having axially-oriented inwardly-facing posts 185, 187 which extend through coaxial pivot mounting apertures in frame sidewalls 53, 59, one of which 189 is shown in FIG. 8 (the other identical aperture is hidden behind guide surface 69) pivotally mounting roller frame assembly 173 to frame 13. Reinforcement members, such as member 191, may extend from the bottom plate 179 to an upstanding wall 193. In the embodiment, bearing surfaces 186, 188 are located at the top of the sidewalls 175, 177 to receive respective stub shafts 170, 171 of tension roller 141 as described in detail below.

A tear bar 71 is provided to facilitate a user tearing the sheet material 111, 113 into discrete sheets. Other cutting arrangements may be provided, such as a guillotine cutter or a cutter which extends and retracts from drive roller 139 of the type shown in commonly owned U.S. Pat. No. 6,446,901 hereby incorporated by reference. The tear bar 71 shown is either mounted to, or is integral with, the bottom of the roller frame assembly 173. The tear bar 71 may be provided with tabs 203 and clips 205 for attachment to the bottom of the roller frame assembly 173 if the tear bar 71 is not molded as part of the roller frame assembly 173. A serrated edge 207 is at the bottom of tear bar 71 for cutting and separating the sheet material 111, 113 into discrete sheets.

Roller frame assembly 173 may further include spring mounts 209, 211 at both sides of roller frame assembly 173. Leaf springs 213, 215 are secured on mounts 209, 211 facing forward with bottom spring leg 217, 219 mounted in a fixed-position relationship with mounts 209, 211 and upper spring leg 221, 223 being mounted for forward and rearward movement. Cover 17, when in the closed position of FIG. 1, urges springs 213, 215 and roller assembly 173 rearwardly thereby urging tension roller 141 firmly against drive roller 139. Springs 213, 215 also enable roller frame assembly 173 to move away from drive roller 139 so that the tension roller 141 "rides over" any irregular (i.e., crumpled or folded) portions of sheet material 111, 113 thereby preventing any potential paper jam condition.

An optional transfer assembly 227 may be provided if it is desired to dispense from plural sources of sheet material 111, 113. Transfer assembly 227 is provided to automatically feed the secondary sheet material 113 into nip 157 upon exhaustion of the primary sheet material 111 thereby permitting the sheet material 113 from roll 41 to be dispensed. Transfer assembly 227 shown is mounted interior of tension roller 141 on bearing surfaces 229, 231 of roller frame assembly 173. Transfer assembly 227 is provided with a stub shaft 233 at one end in bearing surface 229 and a stub shaft 235 at the other end in bearing surface 231. Each bearing surface 229, 231 is located at the base of a vertically-extending elongate slotted opening 237, 239. Each stub shaft 233, 235 is loosely supported in slots 237, 239. This arrangement permits transfer assembly 227 to move in a forward and rearward pivoting manner in the direction of dual arrows 241 and to translate up and down along slots 237, 239, both types of movement being provided to facilitate transfer of sheet material 113 from secondary roll 41 into nip 157 after depletion of sheet material 111 from roll 39 as described below.

As stated, in the embodiment shown, the transfer assembly 227 is mounted for forward and rearward pivoting movement in the directions of dual arrows 241. Pivoting movement of transfer assembly 227 in a direction away from drive roller is limited by hooks 243, 245 at opposite ends of transfer assembly 227. Hooks 243, 245 are shaped to fit around tension roller 141 and to correspond to the arcuate surface 247 of tension roller 141.

Referring to FIG. 9, a transfer mechanism 249 is generally and preferably positioned in a central location of the transfer assembly 227. Transfer mechanism 249 includes a drive roller contact surface 250, an arcuate portion 251 with outwardly extending teeth 253 which are moved against drive roller arcuate surface 257 during a transfer event as described below. A catch 256 is provided to pierce and hold the secondary sheet material 113 prior to transfer of the sheet material to nip 157. Opposed, inwardly facing coaxial pins 259, 261 (see FIG. 8) are mounted on respective ends of transfer assembly 227 also to hold the secondary sheet material 113 prior to transfer to nip 157. Operation of transfer assembly 227 will be described in more detail below.

Drive and tension rollers 139, 141, roller frame assembly 173, transfer assembly 227 and related components may be made of any suitable material. Molded plastic is a particularly useful material for these components because of its durability and ease of manufacture.

Referring now to FIGS. 3-4, 6-9 and 11, there are shown preferred motor and power transmission related components of preferred drive mechanism 45. A motor mount 263 is mounted to inside surface 61 of frame sidewall 59 by fasteners of which screw 265 is exemplary. A direct current geared motor 267 is attached to mount 263. A suitable DC geared motor is the model 25150-50 motor available from Komocon Co. Ltd. of Seoul, Korea. Motor 267 may be enclosed by motor housing 269 mounted over motor 267 to mount 263. Motor 267 is preferably powered by four series-connected 1.5 volt D-cell batteries, two of which 271, 273 are shown in FIGS. 9 and 10. Optionally, motor 267 may be powered by direct current from a low-voltage AC-to-DC transformer (not shown).

In the embodiment, motor 267 drives a power transmission assembly consisting of an input gear 275, an intermediate gear 276, and drive gear 155. Input gear 275 is mounted on a motor shaft 279. Input gear teeth 281 mesh with teeth 283 of intermediate gear 276 which is rotatably secured to a housing 285 by a shaft 287 extending from housing 285. Teeth 283 in turn mesh with drive gear teeth 289 to rotate drive gear 155 and drive roller 139.

Housing 285 covers gears 155, 275 and 276 and is mounted against sidewall outer surface 63 by an armature 291 having an opening 293 fitted over post 99. Bushing 95 secured between walls 23 and 59 by fastener 91 urges armature 291 against sidewall outer surface 63 holding housing 285 in place. Further support for housing 285 is provided by a pin 295 inserted through a mating opening 297 in sidewall 59. Any suitable motor and power transmission arrangement may be used to power drive roller 139. For example, motor 267 may be in a direct drive relationship with drive roller 139.

FIGS. 6-10 show a preferred power supply apparatus 47 for supplying electrical power to motor 267. Power supply apparatus 47 has a power source output which may be the voltage or current produced by the power supply apparatus 47. While the preferred power supply apparatus 47 is described in connection with dry cell batteries, such as batteries 271, 273, it is to be understood that other types of power sources may be used. Such power sources could include low-voltage DC power from a transformer or power from photovoltaic cells or other means.

In the embodiment, a base 299 is mounted in frame 13 by mechanical engagement of base end edge surfaces 301, 303 with corresponding flanges 305, 307 provided along inner surfaces 55, 61 of respective walls 53, 59 and by engagement of tabs 306, 308 with slots 314, 316 also provided in walls 53, 59. Tabs 310, 312 (see FIG. 12) protruding from frame bottom wall 65 aid in locating base 299 by engagement with a base bottom edge 309. Base 299 and frame 13 components are sized to permit base 299 to be secured without fasteners.

A battery box 311 is received in corresponding opening 313 of base 299 and may be held in place therein by any suitable means such as adhesive (not shown) or by fasteners (not shown). Battery box 311 is divided into two adjacent compartments 315, 317 each for receiving two batteries, such as batteries 271, 273, placed end-to-end in series connection for a total of four batteries. Positive and negative terminals and conductors (not shown) conduct current from the batteries to the drive, detector and control apparatus 45, 49 and 50.

Cradle 119 is removably attached to base 299 by means of tangs (e.g., 321, 323 and a further unshown tang) inserted through corresponding openings 325, 327, 329 in base 299. Cradle 119 includes a hollow interior portion 331 corresponding to the profile of battery box 311. Cradle 119 receives battery box 311 therein when cradle 119 is attached to base 299. Tangs 321-323 are made of a resilient material permitting them to be urged out of contact with base 299 so that cradle 119 may be removed to access battery box 311, for example to place fresh batteries (i.e., 271, 273) into battery box 311.

The mechanical structure of a preferred proximity detector apparatus 49 will be now be described particularly with respect to FIGS. 8-13. The proximity detector 49 is a form of a user input device. A user input device is defined as a device by which the user's request for dispensing of product is input to dispenser 10. Proximity detector 49 comprises circuit components 333 mounted on a printed circuit board 335 ("PC board") and a sensor 337 comprising an area of conductor deposited on board 335. Board 335 and circuit components 333 shown in the drawings are stylized and are provided for illustrative purposes only. A detailed description of the actual circuit components and circuit operation is provided below.

Figure 11:
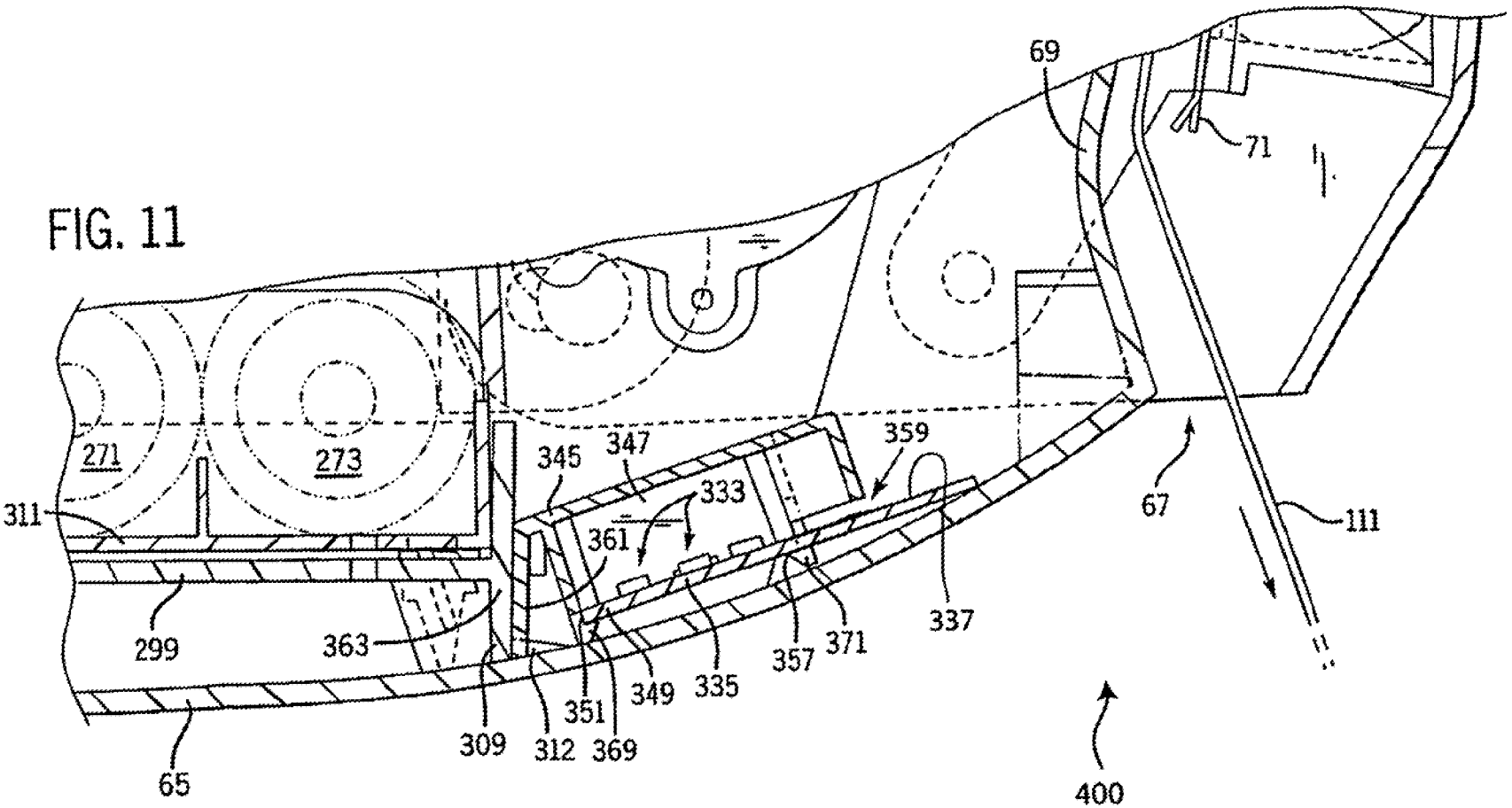
FIG. 11 is an enlarged partial sectional view of the exemplary dispenser of FIGS. 9 and 10. Certain hidden parts are shown in dashed lines.
Figure 12:
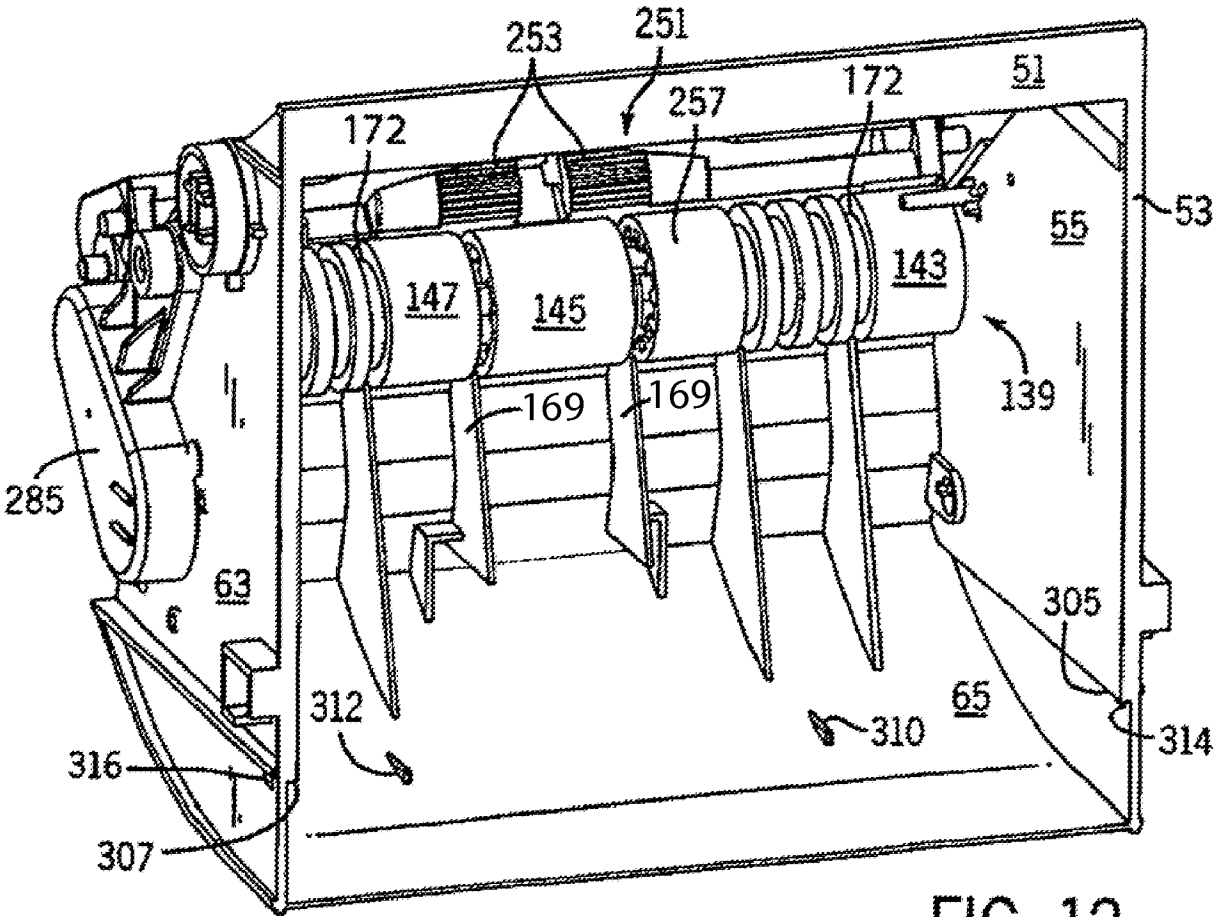
FIG. 12 is a rear perspective view of the rear side of the dispenser frame of FIG. 4. Certain parts are not shown.

PC board 335 on which components 333 are mounted is preferably a rigid resin-based board with electrical conductors (not shown) deposited thereon between the appropriate components 333 as is typical of those used in the electronics industry. PC board 335 is mounted in frame 13 by any suitable arrangement. Housing 345 has a hollow interior space 347 in which components 333 are received. A PC board rear edge 349 is inserted in a slot 351, and a front edge of PC board 353 is inserted in co-planar housing slots, one of which, 357, is shown in FIG. 11 and the other of which is a mirror image of slot 357. Housing 345 includes a front opening 359 through which board 335 extends out of housing 345 toward the front of the dispenser 10. As best shown in FIGS. 8-11, housing 345 is held in place along frame bottom wall 65 with housing rear wall 361 abutting base front wall 363 with tangs 365, 367 engaged with corresponding openings (not shown) in housing rear wall 361. Housing front and rear legs 369, 371 rest on frame bottom wall 65.

Sensor 337 generates a detection zone 400 (FIGS. 1, 9-11) directed toward positions about dispenser 10 most likely to be reached by the outstretched hand or other body part of a user positioned to receive sheet material 111, 113 from web discharge opening 67.

Figure 14A:
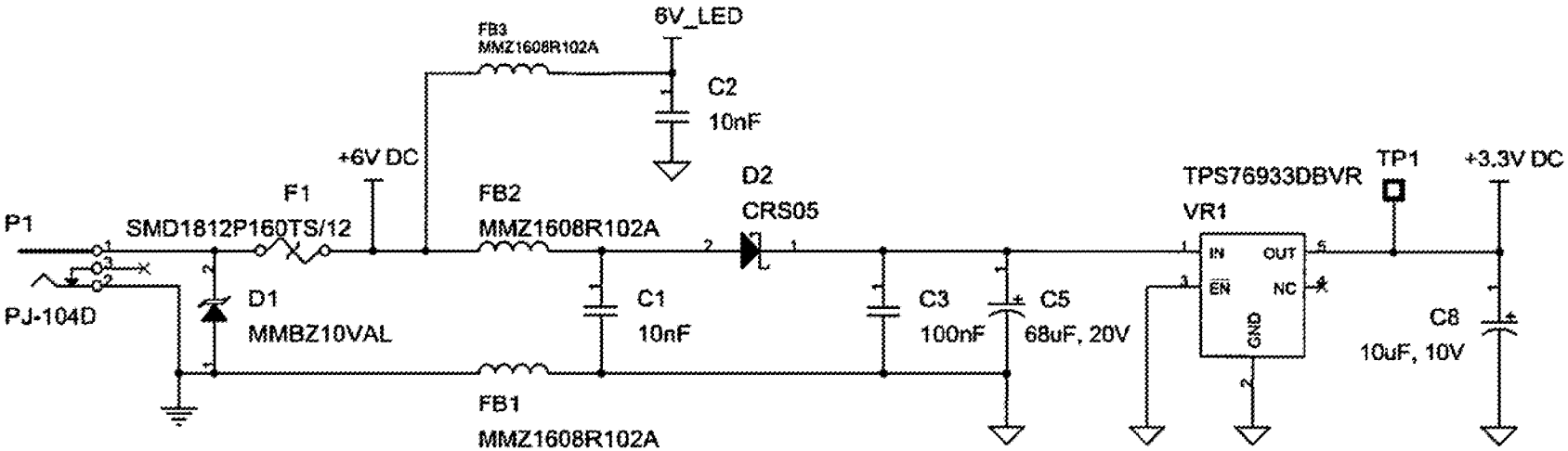
FIGS. 14A-14D are schematic circuit diagrams showing an embodiment of preferred electrical components.
Figure 14B:
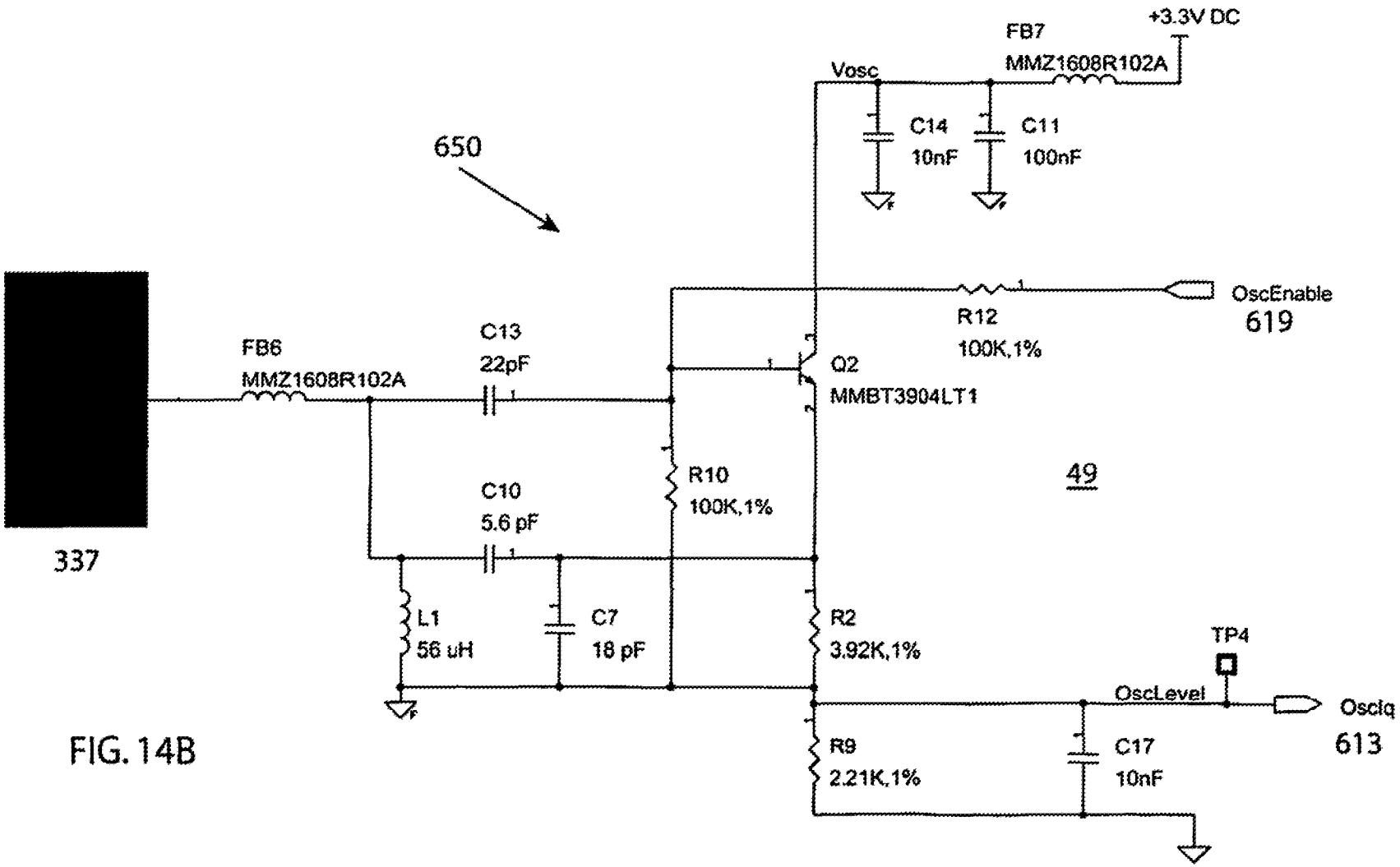

The structure and operation of exemplary proximity detector apparatus 49 and control apparatus 50 will now be described in connection with FIGS. 14A-14D. Control apparatus 50 is also referred to herein as a "controller." FIGS. 14A-14D are circuit diagrams showing proximity detector 49 and the circuitry associated with control apparatus 50 for controlling the operation of dispenser 10. FIG. 14A is a circuit diagram of an embodiment of a regulated power supply for dispenser 10. FIG. 14B is a circuit diagram of a portion of proximity detector 49, primarily oscillator 650. (Portions of detector 49 reside within the firmware and other elements of a micro-controller 511.) Operation of oscillator 650 is well-known to those skilled in the art of electronic circuitry. Certain aspects of the operation of oscillator 650 are referred to in further detail in the later sections of this document.

Figure 14C:
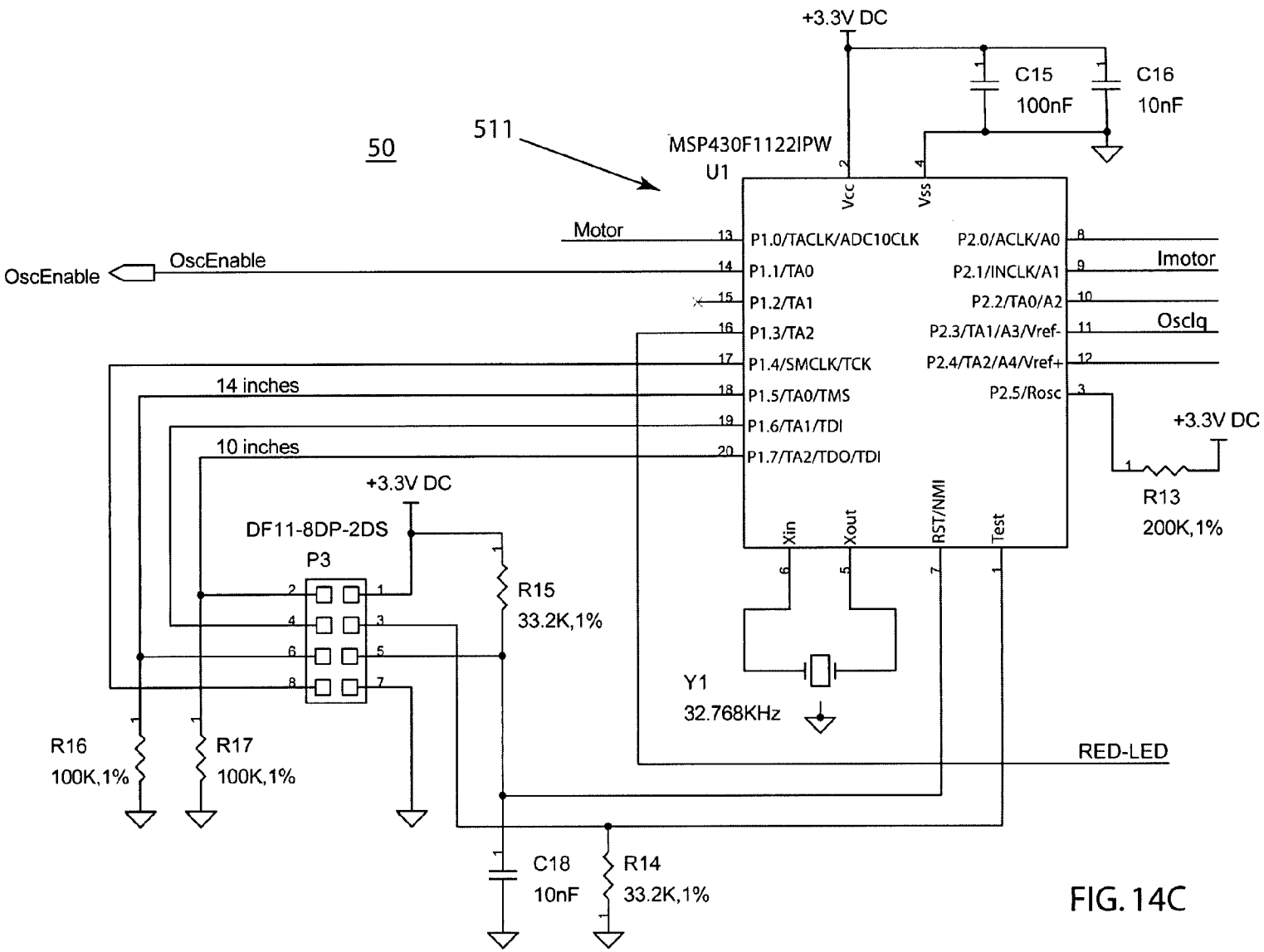

FIG. 14C shows a further portion of the circuitry within an exemplary controller 50. Reference number 50 is shown on FIGS. 13, 14C and 18 indicating both the hardware and firmware nature of controller 50 in this embodiment. Controller 50 includes micro-controller 511 which is programmed with firmware adapted to or configured to operate in the manner described below. The various system states in which dispenser 10 operates are held in the form of logic levels and numeric values within micro-controller 511. For example, a suitable micro-controller is a MSP430F11221PW chip made by Texas Instruments Incorporated of Dallas, Tex., USA. Micro-controller 511 includes analog-to-digital (A/D) converters which are configured to measure a number of quantities such as supply voltage $V_s$. The operation of such a programmable micro-controller is well-known and understood by those skilled in the art of control systems and electronics.

Figure 14D:
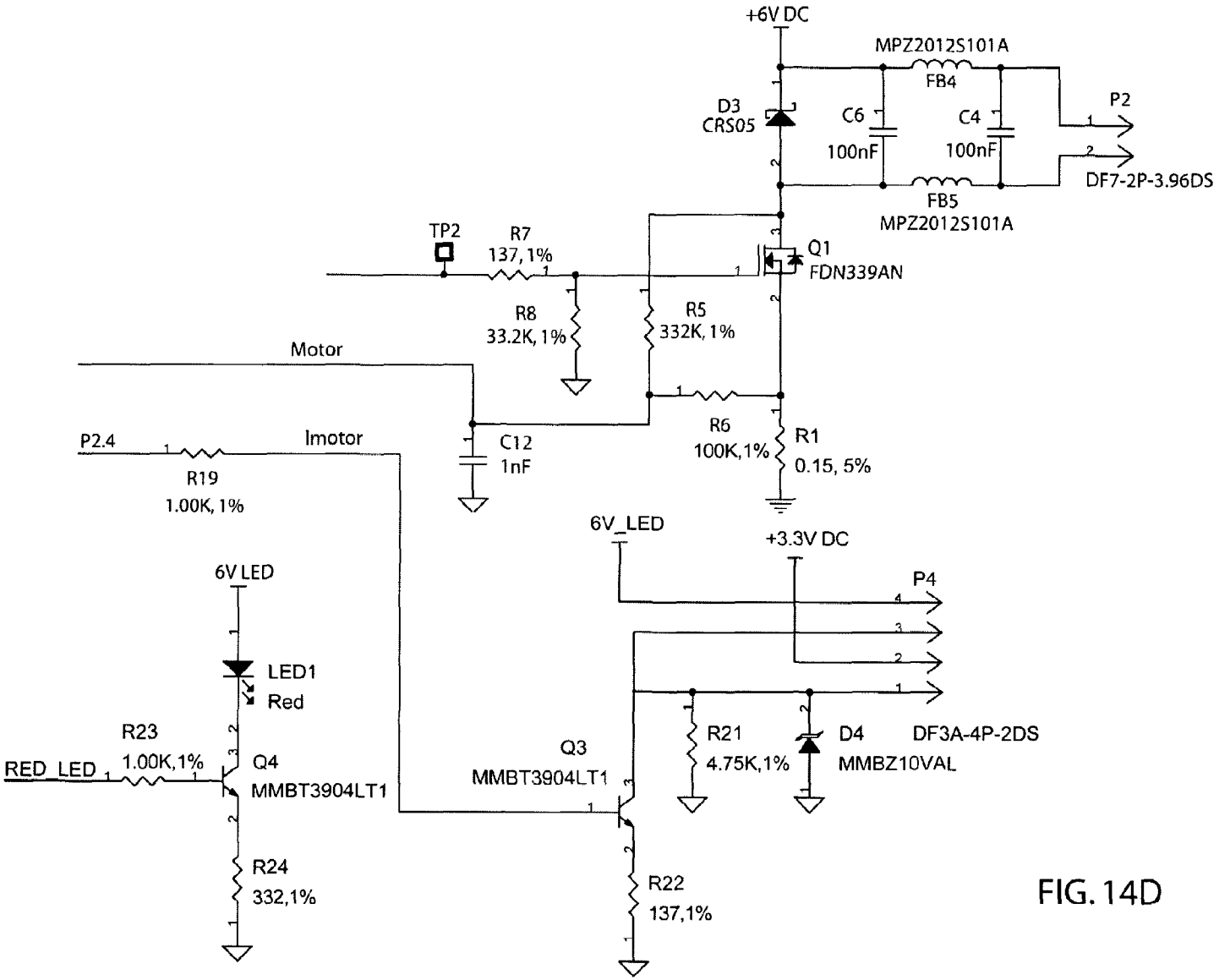

FIG. 14D shows an additional portion of the circuitry of controller 50. FIG. 14D primarily illustrates the drive circuitry for motor 267, connected to other portions of controller 50 at a connector labeled P2.

Figure 15:
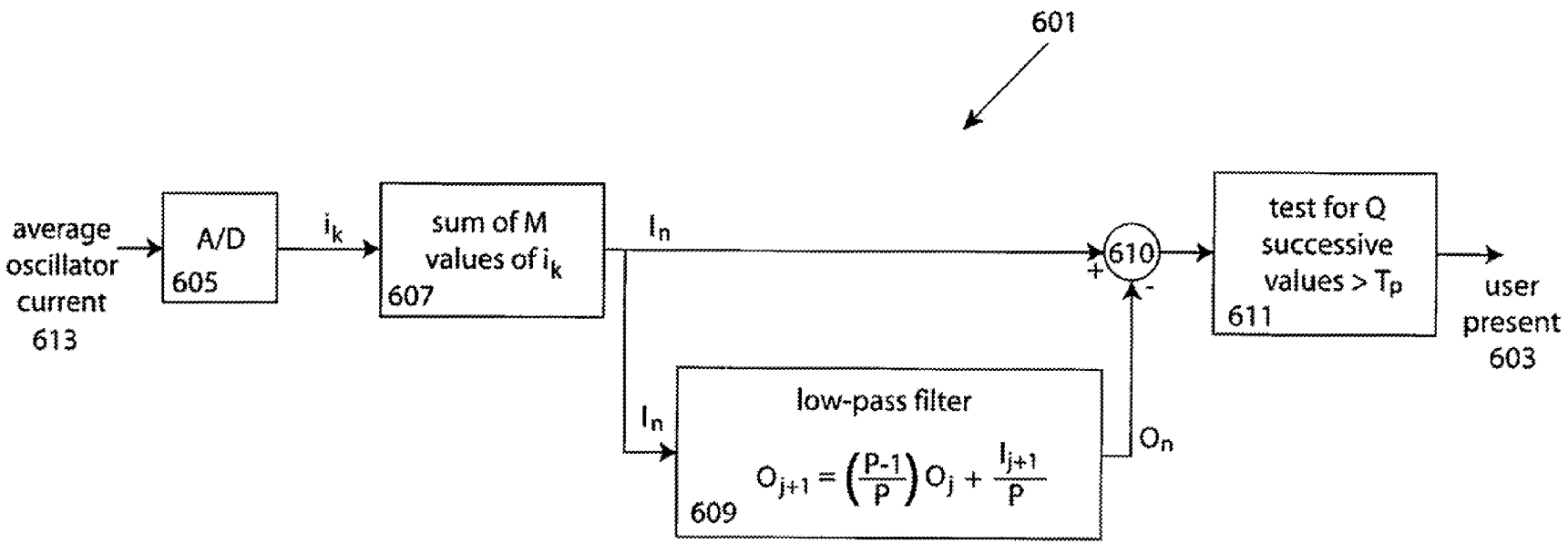
FIG. 15 is a block diagram illustrating the logic of a proximity detector embodiment.
Figure 16:
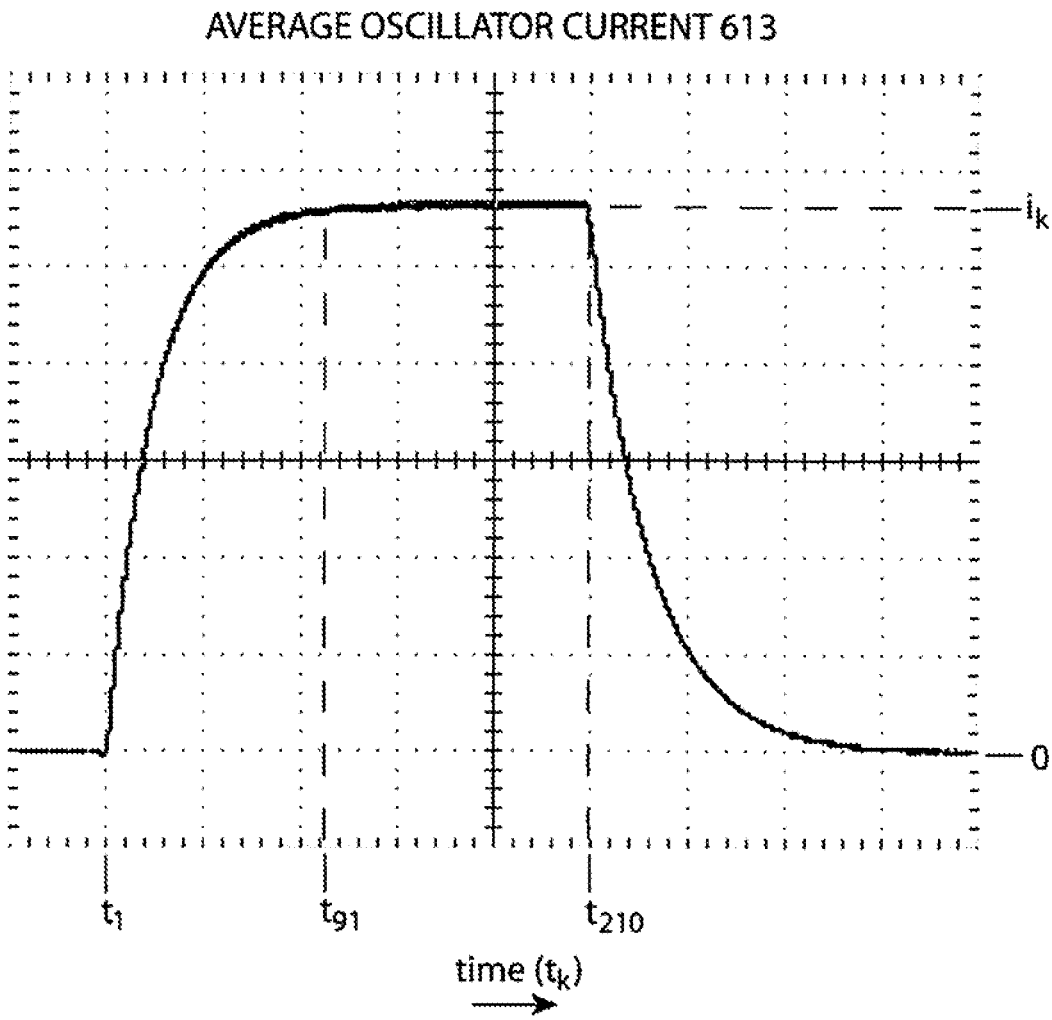
FIG. 16 is a graph illustrating a time plot of average oscillator current during one proximity detector cycle.

FIG. 15 is a block diagram illustrating the operational logic 601 of proximity detector apparatus 49, and FIG. 16 is a graph illustrating a time plot of the average oscillator current 613 during one proximity detector cycle of proximity detector 49. Oscillator 650 is turned on and off in order to lower the power consumption of the circuitry. As commanded by micro-controller 511, an oscillator-enable signal 619 (OscEnable) rises from 0 to 3.3 volts, biasing transistor Q2 and enabling oscillator 650 to oscillate at a nominal frequency of 5 MHz. This occurs at time $t_1$ as shown in FIG. 16. The RC circuit (FIG. 14B) made up of C17 and R9 averages the oscillator current which has both a 5 MHz current component and a DC bias current component. When a user is proximate sensor 337, oscillator 650 is loaded by the change in impedance caused by the presence of the user, causing average oscillator current 613 to decrease by a small amount.

Beginning at time $t_1$, average oscillator current 613, sensed as the voltage across capacitor C17 and resistor R9 in FIG. 14B, is converted to a stream of numerical values by analog-to-digital (A/D) converter 605, approximately once every 9.5 microseconds (μsec). (A/D converter 605 is part of micro-controller 511.) As shown in FIG. 16, average oscillator current 613 rises from 0 (from oscillator 650 being "off") to an equilibrium level $i_k$ in about 90 cycles of A/D conversion, each conversion being approximately 2 μsec long (out of the 9.5 μsec per conversion cycle). Within this example, the equilibrium level of current has a numerical A/D count value of about 380 when the user is not proximate sensor 337.

In this embodiment, oscillator 650 is turned on 20 times per second. As described above, oscillator 650 is on for 210×9.5 μsec≈2 msec; thus oscillator 650 has a duty cycle of 4%.

Beginning at time $t_{91}$, the next 120 values in the stream of numerical values is summed, at which point (time=$t_{210}$), oscillator 650 is turned off by oscillator signal 619 going to 0. The sum of 120 values from the stream of numerical values is approximately 46,000 when the user is not proximate sensor 337. The summing process is indicated by reference number 607 in FIG. 15 with M=120.

Figure 17:
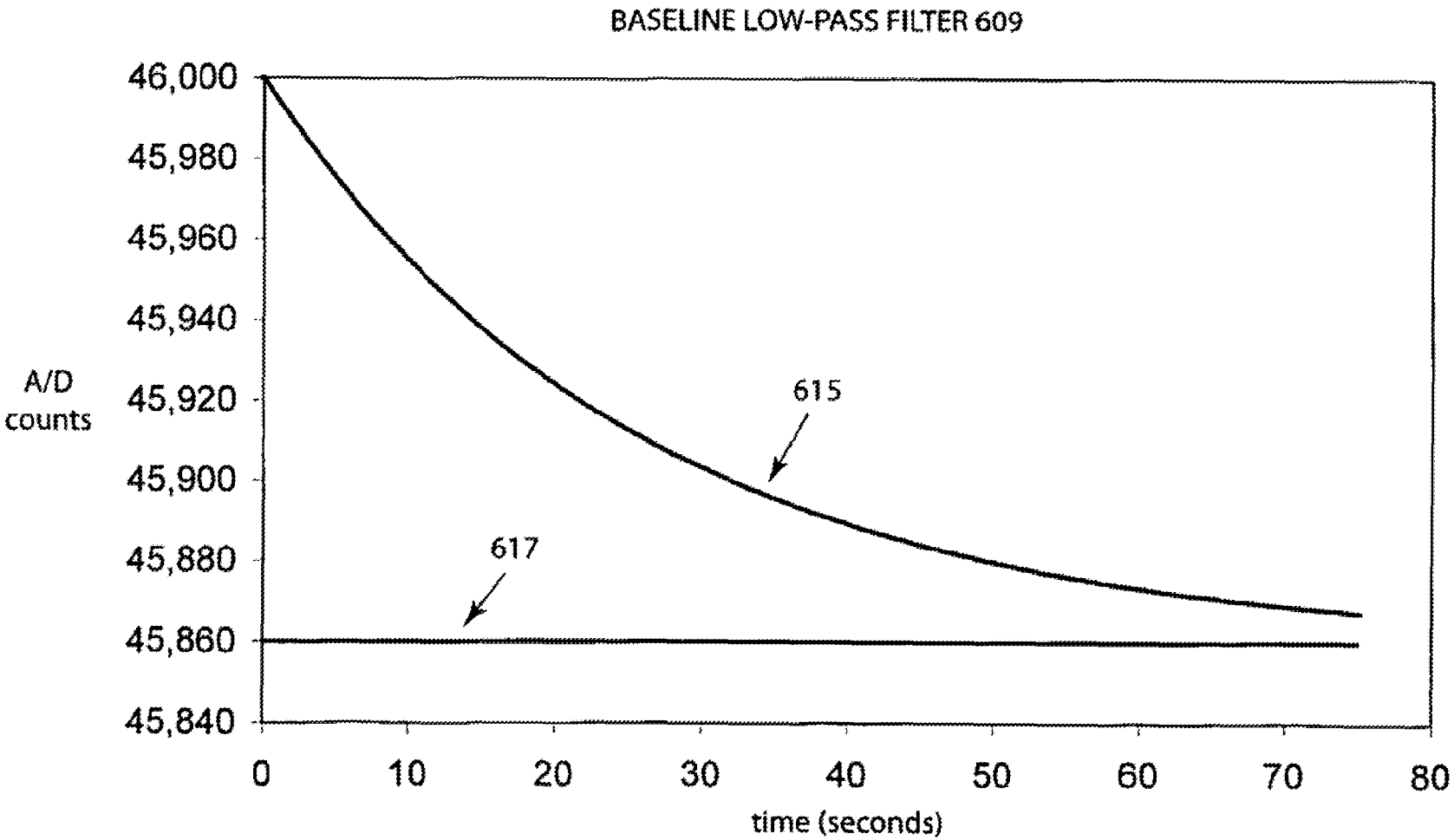
FIG. 17 is a graph illustrating a time plot of the response of a representative baseline low-pass filter.

Summing process 607 thus produces a stream of numerical values labeled $I_n$ in FIG. 15. Stream $I_n$ is then filtered by a digital low-pass filter 609. The output $O_n$ of filter 609 is a stream of numerical values computed sequentially by the filter equation as follows: $O_{j+1}=[(P-1)/P]\times O_j+(I_{j+1})/P$ where j is the index of the value in the stream and j+1 is the index of the subsequent value in the stream. As can be seen from this mathematical relationship, the output stream of values $O_n$ will change very slowly compared to any change in the input stream of values $I_n$. This is illustrated in FIG. 17. Curve 615 represents the values of output stream $O_n$ resulting from an instantaneous change (e.g., a rapid insertion of a hand in detection zone 400) in the value of input stream $I_n$ from 46,000 to 45,860 occurring at time=0. (Within this example, the value of $I_n$ while a user is proximate sensor 337 is shown in curve 617 as 45,860.)

The time constant of such a low-pass filter is P cycles. In this embodiment, P=512 during operation and the cycle time is 50 msec. Thus, the time constant of filter 609 is approximately 26 seconds. (During start-up of proximity detector 49, P is temporarily assigned a value of 32 so that filter 609 reaches a useful value more quickly.)

FIG. 17 illustrates that output stream $O_n$ provides a baseline value for proximity detector 49. Also referring to FIG. 15, the two numerical streams of values, $I_n$ and $O_n$, are differenced at summing point 610 in proximity detector logic 601. Absent a user proximate sensor 337, the two streams of values will be approximately equal. However, when a user comes near sensor 337, the values of stream $I_n$ change, and the value of the difference (here −140 A/D counts) is significant. At step 611 in proximity detector logic 601, successive values of the difference are compared to a threshold values $T_p$, and when Q successive values exceed $T_p$, a user present signal is set to YES. (The description of user present signal as being set to YES is merely a convenience for discussion of proximity detector logic 601. Logic states within micro-controller 511 can be represented in numerous ways within the logic being carried out.) In this embodiment, Q=3 and $T_p$ is on the order of −70 such that three successive values must attain the −70 threshold. As described herein, the term "attain a threshold" is used to indicate that a threshold is reached or passed as appropriate. For example, threshold $T_p$ is a negative number, and the values of the differences in general are also negative. The difference values move from values near 0 to negative values less than $T_p$. This corresponds to the threshold $T_p$ being attained. In other cases, positive values are appropriate and attaining such a threshold corresponds to a value reaching or exceeding such a threshold.

The behavior of filter 609 is such that stream $O_n$ follows the environment of dispenser 10. For example, changes such as in the temperature or humidity of the room in which dispenser 10 is located may have an effect on the loading of oscillator 650 such that streams $I_n$ and $O_n$ reach an equilibrium value different from the 46,000 exemplary value. Nevertheless, when a user is proximate sensor 337, average oscillator current 613 will change from the baseline value and allow detection of the user. Thus proximity detector 49 is relatively insensitive to changes in the environment of dispenser 10.

The process of summing M successive values of average oscillator current 613 serves to increase the sensitivity of proximity detector 49. Noise in current 613 is typically unbiased such that variations in current caused by such noise will not increase the value of the sum (there are as many A/D measurements less than the average as there are greater than the average), and thus the magnitude of the sum amplifies the value of the difference generated at step 610.

Figure 18:
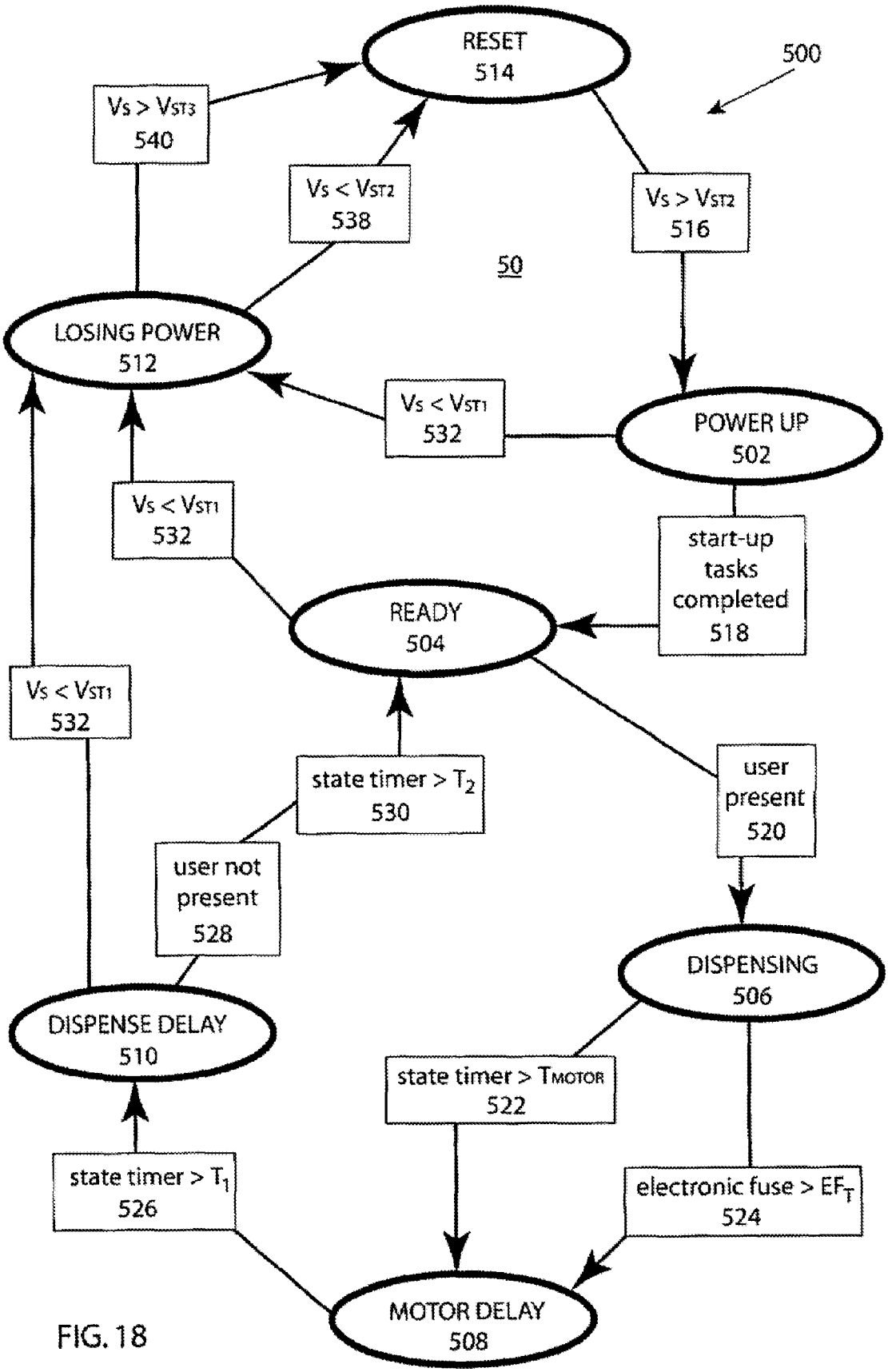
FIG. 18 is a schematic diagram illustrating the control logic of a representative automatic product dispenser including a proximity detector.

FIG. 18 is a schematic diagram illustrating the control logic 500 of automatic product dispenser 10 including proximity detector 49 and controller 50. The schematic diagram of FIG. 18 is a state diagram describing the operation of dispenser 10. Control of dispenser 10 is structured to operate in seven states, as follows: POWER UP 502; READY 504; DISPENSING 506; MOTOR DELAY 508; DISPENSE DELAY 510; LOSING POWER 512; and RESET 514. (The numbers following the name of each state in the preceding list are the reference numbers used in the description of the operation of dispenser 10.) Also in the description herein, when control apparatus 50 is operating in a particular state, the "system" is said to be "in" that particular state. Thus, when power is being supplied to control apparatus 50, the "system" is described as being "in" one of these seven states. In FIG. 18, the system states are represented by the bold ellipses.

Control apparatus 50 transitions from one state to another based on the occurrence or satisfaction of certain conditions. These conditions are tested frequently while the system is in the various system states. As can be seen in FIG. 18, certain states among the seven are directly reachable (i.e., in one state transition, represented by connecting lines with arrows and conditions) from other states. For example, READY state 504 can be reached or entered directly only from POWER UP state 502 and DISPENSE DELAY state 510. As noted above, the transition from one state to another is caused by the occurrence or satisfaction of one or more conditions. Control apparatus 50 is configured and programmed to test the occurrence or satisfaction of certain of these conditions when the system is in a particular state. In this description, each of these conditions is shown in a rectangular element and is identified by a reference number. For example, when the system is in READY state 504, two conditions are tested: condition 520 (the presence of a hand) and condition 532 (supply voltage $V_s$ less than a first power source voltage threshold $V_{ST1}$). While the system is in READY state 504, if a logic variable which is set by proximity detector 49 sensing the presence of a hand in detection zone 400 of dispenser 10 (i.e., condition 520 occurs), the system transitions to DISPENSING state 506. Likewise, if the supply voltage $V_s$ drops below first power source voltage threshold $V_{ST1}$ (condition 532 occurs), the system transitions to LOSING POWER state 512.

Operation of control apparatus 50 is now fully described as follows. When power is applied to control apparatus 50, the system enters POWER UP state 502 during which various start-up tasks such as variable initialization are carried out by micro-controller 511. While the system is in RESET state 514, the system checks at 516 to determine if supply voltage V, exceeds a second power source voltage threshold $V_{ST2}$. If this condition is met, then sufficient battery voltage is present and the system proceeds to POWER UP state 502. Upon completion of these start-up tasks (condition 518), the system enters READY state 504. However, while in POWER UP state 502, the system also checks if supply voltage $V_s$ is below first power source voltage threshold $V_{ST1}$ (condition 532). In this embodiment, a value for $V_{ST1}$ may be on the order of 4.3 volts. If $V_s$ drops below $V_{ST1}$, the system transitions to LOSING POWER state 512.

While the system is in READY state 504, two conditions are tested. Condition 520 is satisfied when user present signal 603 has been set to YES by proximity detector logic 601. If condition 520 is satisfied, the system transitions to DISPENSING state 506. When the system transitions to DISPENSING state 506, a state timer is started. While the system is in READY state 504, the system also tests for condition 532 as described in the preceding paragraph. If $V_s$ drops below $V_{ST1}$, the system transitions to LOSING POWER state 512.

While the system is in DISPENSING state 506, two conditions are tested. The system tests to see if an electronic fuse value has exceeded an electronic fuse threshold $EF_T$. If $EF_T$ has been exceeded, the system enters MOTOR DELAY state 508, at this point turning off power to motor 267 and restarting the state timer. (Operation of the electronic or digital fuse will be discussed later in this document.) While in DISPENSING state 506, the system also checks at 522 to see if the state timer exceeds a motor run time $T_{MOTOR}$, and if so, the system transitions to MOTOR DELAY state 508, turns off power to motor 267 and restarts the state timer. Values for $T_{MOTOR}$ are determined based on how much product is to be dispensed and the dispensing characteristics of product dispenser 10.

While the system is in MOTOR DELAY state 508, the system checks at 526 to see if the state timer exceeds a delay time $T_1$, and if so, the system transitions to DISPENSE DELAY state 510 and restarts the state timer. The operational purpose of MOTOR DELAY state 508 is to allow motor 267 to coast to a stop, i.e., to complete the dispensing of product before taking any further action in control logic 500. A value for $T_1$ in this embodiment can be on the order of one second.

While the system is in DISPENSE DELAY state 510, three conditions are tested. The system checks if supply voltage $V_s$ is below first power source voltage threshold $V_{ST1}$ (condition 532). If $V_s$ drops below $V_{ST1}$, the system transitions to LOSING POWER state 512. While the system is in DISPENSE DELAY state 510, the system checks to see if two other conditions are met simultaneously. These two conditions are (1) that the user present signal must be NO (condition 528) and (2) the state timer must exceed a second delay threshold $T_2$ (condition 530). If conditions 528 and 530 are both met, the system transitions to READY state 504. The purpose of DISPENSE DELAY state 510 is to prevent unwanted repetitive triggering of automatic product dispenser 10.

While the system is in LOSING POWER state 512, the system monitors two conditions. The system tests to see if supply voltage $V_s$ is less than a second power source voltage threshold $V_{ST2}$ (condition 538). If $V_s$ is less than $V_{ST2}$, the system transitions to RESET state 514. While the system is in LOSING POWER state 512, the system also checks to see if supply voltage $V_s$ is greater than a third power source voltage threshold $V_{ST3}$ (condition 540). If condition 540 is met, the system transitions to RESET state 514. In this embodiment, a value for $V_{ST2}$ may be on the order of 1.7 volts, and a value for $V_{ST3}$ may be on the order of 4.75 volts. The purpose of the first, second and third power source voltage thresholds is to allow micro-controller 511 operation only when sufficient voltage is present to ensure proper operation.

This embodiment of automatic product dispenser 10 includes an electronic fuse (digital fuse), represented as condition 524 in FIG. 18. Electronic fuse 524, realized within the set of instructions within micro-controller 511, protects dispenser 10 from the unwanted effects of operating a defective motor 267 in dispenser 10. The current to motor 267 is converted to numeric values using A/D converter 605, and the numeric values of the motor current are compared to a first fuse threshold $EF_{T1}$. If the motor current exceeds threshold $EF_{T1}$, then the amount by which those values exceed $EF_{T1}$ are integrated (summed). Then the integral (sum) is compared to a second fuse threshold $EF_T$, and if threshold $EF_T$ is exceeded, controller 50 is programmed to prevent operation of motor 267. In this embodiment of dispenser 10, threshold $EF_{T1}$ is set to 3.5 amperes, and threshold $EF_T$ is set to 0.2 amp-secs. Threshold $EF_{T1}$ is set to be exceeded only if motor 267 is defective and draws a dangerous excess of current. On each dispense cycle, the electronic fuse is reset.

Operation of exemplary automatic dispenser 10 and an exemplary method of dispensing will now be described. The method of dispensing will be adapted to the specific type of automatic dispenser apparatus utilized with the proximity detector.

The first step of the dispensing method involves loading the dispenser with product to be dispensed. For the sheet material dispenser 10, such loading is accomplished with respect to dispenser 10 in the following manner. The dispenser cover 17 is initially opened causing roller frame assembly 173 to rotate outwardly about axially aligned pivot openings positioned in frame sidewall 53, 59, one of which is identified by reference number 189 (FIG. 8). The rotational movement of frame assembly 173 positions tension roller 141 and transfer assembly 227 away from drive roller 139 providing unobstructed access to housing interior 15 and space 75.

When dispenser 10 is first placed in operation, a roll 41 of sheet material, such as paper toweling or tissue, may be placed on yoke 125 by spreading arms 131, 133 apart to locate the central portions of holders 135, 137 into roll core 117. Sheet material 111 is positioned over drive roller 139 in contact with drive roller segments 143-147. A roll could be stored on cradle 119 awaiting use. Further, cradle 119 could be removed temporarily to insert fresh batteries into battery box 311. Thereafter, cover 17 is closed as shown in FIG. 1. Movement of cover 17 to the closed position of FIG. 1 causes the leaf springs 213, 215 mounted on the roller frame assembly 173 to come in contact with the inside of cover 17 resiliently to urge the tension roller 141 into contact with sheet material 111 from roll 39 thereby ensuring frictional contact between the sheet material 111 and the drive roller 139 and, more particularly, drive roller segments 143-147. The dispenser 10 is now loaded and ready for operation.

Subsequent steps involve the electrical components of the proximity detector and control apparatus 49, 50 as described elsewhere.

Operation of dispenser 10 after detection of a user causes rotation of drive roller 139 by motor 267. This draws sheet material 111 through nip 157 and out of dispenser 10 through discharge opening 67. The user may then separate sheet 111 into a discrete sheet by lifting sheet 111 up and into contact with tear bar 71 serrated edge 207, tearing the sheet 111.

After repeated automatic dispensing cycles, cover 17 is removed to permit replenishment of sheet material 111. At this time, a portion of stub roll 39 may remain and reserve roll 41 of sheet material can be moved into position. As illustrated in FIG. 9, partially dispensed stub roll 39 (preferably having a diameter of about 2.75 inches or less) is now moved onto cradle 119 arcuate surfaces 121, 123. Sheet material 111 extending from stub roll 39 continues to pass over drive roller 139.

After stub roll 39 is moved to the position in frame 13 shown in FIG. 9, a fresh reserve roll 41 can be loaded onto yoke 125. Sheet material 113 is then threaded onto the transfer assembly 227. More specifically, sheet material 113 is urged onto catch 256 which pierces through the sheet material 113. Sheet material 113 is further led under pins 259, 261 to hold sheet material 113 in place on the transfer assembly 227 as shown in FIG. 9. Transfer assembly surface 250 rests against sheet material 111. Surface 250 will ride along sheet material 111 without tearing or damaging material 111 as it is dispensed. The cover 17 is then closed to the position shown in FIG. 1.

After further automatic dispensing cycles, sheet material 111 from stub roll 39 will be depleted. Upon passage of a final portion of sheet material 111 through nip 157, transfer surface 250 will come into direct contact with arcuate surface 257 of drive roller 139. Frictional engagement of drive roller segment 145 and surface 250 causes transfer assembly 227 to pivot rearwardly and slide up along slots 237, 239. Movement of transfer assembly 227 as described brings teeth 253 along arcuate surface 251 into engagement with drive roller segment 145. Engagement of teeth 253 with the frictional surface of segment 145 forcefully urges sheet material 113 held on catch 256 into contact with drive roller surface 257 causing sheet material 113 to be urged into nip 157 resulting in transfer to roll 41 as shown in FIG. 10. Following the transfer event, transfer assembly 227 falls back to the position shown in FIG. 10. Thereafter, sheet material 113 from roll 41 is dispensed until depleted or until such time as the sheet material rolls are replenished as described above.

The invention is directed to automatic dispenser apparatus generally and is not limited to the specific automatic dispenser embodiment described above. For example, there is no requirement for the dispenser to dispense from plural rolls of sheet material, and there is no requirement for any transfer mechanism as described herein. The sheet material need not be in the form of a web wound into a roll as described above. The novel proximity detector 49 and control apparatus 50 will operate to control dispensing mechanism 43 of virtually any type of automatic sheet material dispenser, including dispensers for paper towel, wipes and tissue.

Figure 19:
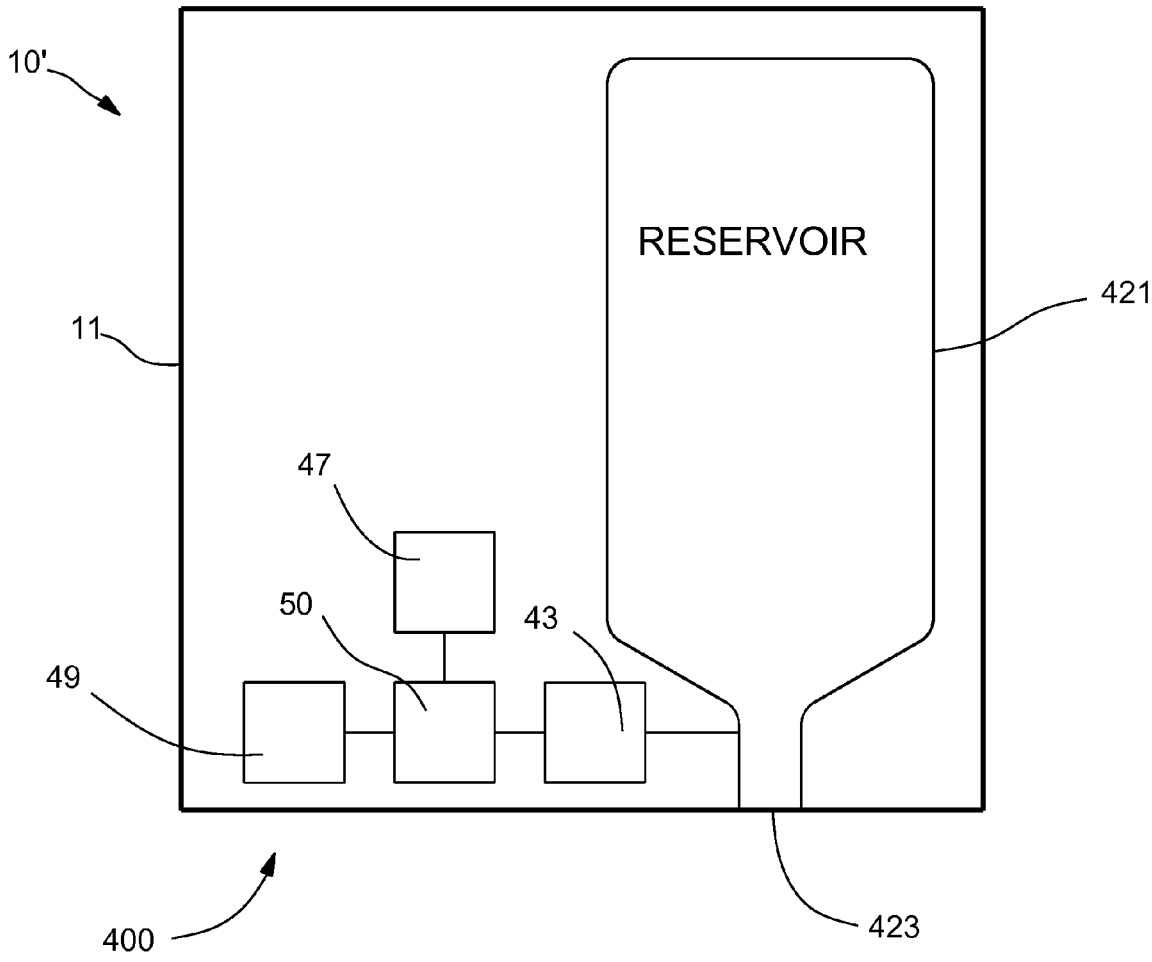
FIG. 19 is a schematic drawing of a soap dispenser embodiment.

The novel proximity detector 49 will also operate with automatic dispensers other than sheet material dispensers and could be used in applications other than with dispensers. For example and referring to FIG. 19, the proximity detector will operate to control automatic personal care product dispensers, such as liquid soap dispensers. In a soap dispenser 10 ' embodiment, the power supply apparatus 47, proximity detector 49 and control apparatus 50 components may be housed in an automatic soap dispenser apparatus housing 11. Dispensing mechanism 43 may be a solenoid or other mechanical actuator. An appropriate fluid reservoir 421 in communication with the solenoid or actuator (i.e., dispensing mechanism 43) is provided to hold the liquid soap. The solenoid or other actuator discharges soap from the dispenser through a fluid-discharge port 423. Detection zone 400 is generated below the soap dispenser 10 ' adjacent the fluid-discharge port 423. The programmed instructions in microcontroller 511 will be tailored to the specific type of soap dispenser being used, for example to limit the number of dispensing cycles per detection event and to limit the dwell time between dispensing cycles.

The dispenser apparatus may be made of any suitable material or combination of materials as stated above. Selection of the materials will be made based on many factors including, for example, specific purchaser requirements, price, aesthetics, the intended use of the dispenser, and the environment in which the dispenser will be used.

While the principles of this invention have been described in connection with specific embodiments, it should be understood clearly that these descriptions are made only by way of example and are not intended to limit the scope of the invention.

The subject matter claimed is:

1. An automatic product dispenser comprising:
- a housing adapted to receive a dispensable product;
- an electrically-powered dispensing mechanism adapted to dispense the product from the dispenser; and
- a proximity detector operable to:
  - generate a first digital signal which changes at a first rate responsive to a user proximate the dispenser;
  - convert the first digital signal to a second digital signal which changes at a second rate responsive to the user;
  - difference the signals; and
  - trigger operation of the dispensing mechanism when the difference attains a threshold.

2. The dispenser of claim 1 wherein the proximity detector further comprises:
- a sensor;
- an oscillator operatively connected to the sensor having an oscillator signal which changes responsive to the user;
- an analog-to-digital converter adapted to convert the oscillator signal into the first digital signal, said first digital signal comprising a first numerical value stream;
- a low-pass filter adapted to convert the first numerical value stream into the second digital signal, said second digital signal comprising a second numerical value stream; and
- a controller operable to difference the first and second numerical value streams and to trigger dispensing mechanism operation when the difference attains the threshold.

3. The dispenser of claim 2 wherein the oscillator has a current and the oscillator signal is an average of the current.

4. The dispenser of claim 2 wherein the controller includes a processor, a memory and a set of instructions, the controller being adapted to perform the analog-to-digital conversion, low-pass filtering, differencing and triggering functions.

5. The dispenser of claim 4 wherein the instructions are adapted to:
- sum the first numerical value stream to provide a first summed numerical value stream;
- low-pass filter the first summed numerical value stream to provide the second digital signal, said second digital signal comprising a second summed numerical value stream;
- difference the first and second summed numerical value streams; and
- trigger operation of the dispensing mechanism when the difference between the first and second summed numerical value streams attains the threshold, whereby, differences between the first and second digital signals are amplified, thereby increasing proximity detector sensitivity.

6. The dispenser of claim 5 wherein the instructions are further adapted to operate the dispensing mechanism when a plurality of consecutive differences attain the threshold.

7. The dispenser of claim 4 further comprising a battery power source, and wherein the instructions are further adapted to periodically turn the oscillator on and off, thereby saving battery power.

8. The dispenser of claim 7 wherein the instructions are further adapted to periodically place the processor in a low-power mode and to come out of the low-power mode, thereby saving battery power.

9. The dispenser of claim 4 further comprising:
- a motor powering the dispensing mechanism; and
- a digital fuse operatively connected to the motor and protecting the dispenser.

10. The dispenser of claim 9 wherein the digital fuse resides in the instructions, and the instructions are further adapted to:
- obtain numerical values of motor current;
- compare the motor current values with a first threshold;
- when the motor current values exceed the first threshold, sum the motor current values;
- compare the summed motor current values with a second threshold; and
- prevent motor operation when the second threshold is exceeded.

11. The dispenser of claim 4 wherein the dispenser is a towel dispenser and the dispensing mechanism comprises:
- a drive roller;
- a motor in power-transmission relationship with the drive roller;
- a tension roller positioned against the drive roller to form a nip therebetween; and
- the controller triggers electrical current to the motor responsive to detection of the user.

12. The dispenser of claim 4 wherein the dispenser is a liquid product dispenser including a liquid product reservoir and the dispensing mechanism comprises:
- an actuator adapted to dispense the liquid product from the reservoir; and
- the controller triggers electrical current to the actuator responsive to detection of the user.

13. A proximity detector comprising:
- an oscillator which generates an oscillator signal which changes responsive to a user proximate the detector;

an analog-to-digital converter adapted to receive the oscillator signal and to generate a first digital signal comprising a first stream of digital numerical values; and a processing device programmed with instructions that, when executed, perform a method for detecting the user, the method comprising:

filtering the first digital signal with a low-pass filter to generate a second digital signal comprising a second stream of digital numerical values;

differencing the first and second streams of digital numerical values; and generating a signal representing detection of the user when the difference attains a threshold.

14. The proximity detector of claim 13 further comprising a sensor operatively connected to the oscillator.

15. The proximity detector of claim 14 wherein the oscillator has a current and the oscillator signal is an average of the current.

16. The proximity detector of claim 13 wherein the analog-to-digital converter and the processing device are formed on the same integrated circuit.

17. The proximity detector of claim 13 wherein the method performed by the processing device further comprises:

summing the first stream of digital numerical values before filtering;

filtering the summed first stream of digital numerical values with the low pass filter to generate the second digital signal, said second digital signal comprising a summed second stream of digital numerical values; and differencing the summed first and second streams of digital numerical values, whereby, differences between the first and second digital signals are amplified, thereby increasing proximity detector sensitivity.

18. The proximity detector of claim 17 wherein the method performed by the processing device further comprises operating the dispensing mechanism when a plurality of consecutive differences attain the threshold.

19. The proximity detector of claim 13 further comprising a battery power source, and wherein the method performed by the processing device further comprises periodically turning the oscillator on and off, thereby saving battery power.

20. The proximity detector of claim 19 wherein the method performed by the processing device further comprises:

periodically placing the processing device in a low-power mode; and periodically taking the processing device out of the low-power mode, thereby saving battery power.

21. A method for controlling operation of an automatic product dispenser comprising:

generating a first digital signal which changes at a first rate responsive to a user proximate the dispenser;

low-pass filtering the first digital signal to produce a second digital signal which changes at a second rate responsive to the user;

differencing the signals; and triggering dispenser operation when the difference attains a threshold.

22. The method of claim 21 further comprising generating an average oscillator current signal which changes responsive to the user being proximate the dispenser, and wherein generating the first digital signal further comprises converting the average oscillator current signal to the first digital signal.

23. The method of claim 22 wherein the first and second digital signals each represent a stream of numerical values and differencing the signals further comprises differencing the numerical value streams.

24. The method of claim 23 further comprising:

summing the first digital signal stream of numerical values before low-pass filtering;

filtering the summed first digital signal stream of numerical values with the low pass filter to generate the second digital signal, said second digital signal comprising a summed stream of digital numerical values; and differencing the summed first and second digital signals, whereby, differences between the first and second digital signals are amplified, thereby increasing proximity detector sensitivity.

25. The method of claim 24 wherein triggering dispenser operation further comprises activating the product dispenser when a plurality of consecutive differences attain the threshold.

26. The method of claim 21 further comprising periodically turning the oscillator signal on and off, thereby saving battery power.

27. The method of claim 21 wherein the automatic product dispenser includes a motor-powered dispensing mechanism and the method further comprises protecting the dispenser from over-current conditions with a digital fuse.

28. The method of claim 27 wherein protecting the dispenser further comprises:

obtaining numerical values of motor current;

comparing the motor current values with a first threshold;

when the motor current values exceed the first threshold, summing the motor current values;

comparing the summed motor current values with a second threshold; and preventing motor operation when the second threshold is exceeded.

29. The method of claim 21 further comprising dispensing a towel from the dispenser.

30. The method of claim 29 further comprising deactivating the dispenser after completion of a dispense cycle.

* * * * *

UNITED STATES PATENT AND TRADEMARK OFFICE

CERTIFICATE OF CORRECTION

PATENT NO. : 7,963,475 B2
APPLICATION NO. : 11/566465
DATED : June 21, 2011
INVENTOR(S) : Rodrian It is certified that error appears in the above-identified patent and that said Letters Patent is hereby corrected as shown below:

In column 10, line 30, delete "V," and insert --Vs--.

Signed and Sealed this
Tenth Day of July, 2012

David J. Kappos

David J. Kappos
*Director of the United States Patent and Trademark Office*